US007703877B2

(12) United States Patent
Nagashima

(10) Patent No.: US 7,703,877 B2
(45) Date of Patent: Apr. 27, 2010

(54) LIQUID EJECTION APPARATUS AND CONTROL METHOD FOR APPLYING MENISCUS VIBRATION ACCORDING TO THE VISCOSITY STATES OF NOZZLES

(75) Inventor: Kanji Nagashima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 473 days.

(21) Appl. No.: 11/529,528

(22) Filed: Sep. 29, 2006

(65) Prior Publication Data

US 2007/0076025 A1 Apr. 5, 2007

(30) Foreign Application Priority Data

Sep. 30, 2005 (JP) ..... 2005-288792

(51) Int. Cl.
*B41J 2/165* (2006.01)
*B41J 29/38* (2006.01)
*B41J 2/45* (2006.01)

(52) U.S. Cl. ..... 347/23; 347/6; 347/70

(58) Field of Classification Search ..... 347/6, 347/23

See application file for complete search history.

(56) References Cited

U.S. PATENT DOCUMENTS 5,424,768 A * 6/1995 Dudek et al. ..... 347/29
6,578,958 B2 * 6/2003 Gotoh et al. ..... 347/100
7,195,327 B2 * 3/2007 Kitami et al. ..... 347/11
2001/0003349 A1 6/2001 Hosono
2005/0062792 A1 * 3/2005 Kojima ..... 347/23
2005/0212851 A1 * 9/2005 Akase et al. ..... 347/40

FOREIGN PATENT DOCUMENTS

JP 9-290505 A 11/1997
JP 2001-270134 A 10/2001

* cited by examiner

*Primary Examiner*—Matthew Luu
*Assistant Examiner*—Shelby Fidler
(74) *Attorney, Agent, or Firm*—Birch, Stewart, Kolasch & Birch, LLP

(57) ABSTRACT

A liquid ejecting apparatus with a pressure chamber connected to an ejection nozzle that applies pressure to liquid that causes the liquid to be ejected from the nozzle. An actuator is provided to vibrate a free surface of the liquid in the nozzle without ejecting the liquid from the nozzle. A viscosity state judgment device judges the existence of a first viscosity state near the free surface of the liquid indicating that liquid ejection from the nozzle is possible without applying vibrations, a second state indicating that liquid ejection from the nozzle is possible if vibrations are applied, and a third state indicating that liquid ejection from the nozzle is not possible but restoration to the first state is possible if the vibrating action is performed. A control device then controls liquid ejection from the nozzle based on the judged state.

7 Claims, 11 Drawing Sheets

| | PERIOD FROM FIRST PEAK TO SECOND PEAK | LOGARITHMIC DECREMENT |
|---|---|---|
| VISCOSITY AT NOZZLE: 10cP | 3.71 μ sec | 0.298 |
| VISCOSITY AT NOZZLE: 20cP | 3.76 μ sec | 0.438 |

LIQUID EJECTION APPARATUS AND CONTROL METHOD FOR APPLYING MENISCUS VIBRATION ACCORDING TO THE VISCOSITY STATES OF NOZZLES

BACKGROUND OF THE INVENTION

1. Field of the Invention

The present invention relates to a liquid ejection apparatus and a control method for a liquid ejection apparatus, and more particularly, to a liquid ejection apparatus and a control method for a liquid ejection apparatus in which vibrating action is performed to free surfaces of liquid in nozzles.

2. Description of the Related Art

A liquid ejection apparatus is known which performs vibrating action to liquid in order to prevent the viscosity of the liquid from increasing nearby a free surface (the liquid-atmosphere interface, which is also commonly called "meniscus") of the liquid inside a nozzle (a liquid ejection port).

More specifically, as shown in FIG. 12A, the solvent of ink evaporates from the free surface of the ink in a nozzle 51 due to the difference in the vapor pressure of the solvent between the atmosphere and the ink in the nozzle 51, and as shown in FIG. 12B, the ink inside the nozzle 51 increases in viscosity and solidifies, then the nozzle 51 becomes clogged, thereby creating a state in which ejection is not possible. In order to prevent the nozzle 51 from being clogged, when the nozzle 51 is at rest and ejection is not performed, vibrating action is repeatedly performed for the ink to make the free surface of the ink in the nozzle 51 vibrate slightly to an extent that does not cause ejection of the ink (this action is commonly called "meniscus vibrating action", and is hereinafter referred also to simply as the "vibrating action").

By performing the vibrating action, the increase in the viscosity of the ink in the vicinity of the free surface is restricted due to the churning of the ink inside the nozzle 51, and moreover, as shown in FIG. 12A, the ink inside the ejection flow channel 512 leading to the nozzle 51 and the ink inside a pressure chamber 52 installed with an actuator 58, is also churned. Moreover, the ink inside a supply flow channel 953 which supplies the ink to the pressure chamber 52, and inside a portion of a common flow channel 955, is also churned.

Japanese Patent Application Publication No. 2001-270134 discloses a liquid ejection apparatus which performs the vibrating action on the basis of prescribed churning conditions, at a position where the apparatus has been returned to a standby position by passing through a prescribed distance from the liquid droplet ejection starting point, wherein at least one of the ambient temperature and the ambient humidity is measured, the number of pulses which constitute an electrical signal for the vibrating action (vibration pulses) can be increased or decreased (in other words, the vibrating action duration can be increased or decreased), the frequency of the electrical signal for the vibrating action can be changed, and the amplitude of the electrical signal for the vibrating action can also be changed.

Japanese Patent Application Publication No. 9-290505 discloses a liquid ejection apparatus which performs the vibrating action for a nozzle that has not performed ejection for a specific time period or more, wherein the specific time period is approximately one half of the time period required until the nozzle becomes clogged when the surface of the liquid in the nozzle is exposed to the atmosphere.

However, if the vibrating action to the free surface of the ink is performed repeatedly during an idle duration in ejection, then although the viscosity of the ink in the vicinity of the free surface is reduced for a short while, the solvent evaporates again from the free surface of the ink in the nozzle 51 where the viscosity has been reduced once, and the ink viscosity continuously rises in the whole of the flow channel, including the ejection flow channel 512 to the nozzle 51 and the pressure chamber 52. Therefore, eventually, beneficial effects cease to be obtained, even if the vibrating action is performed. Consequently, if the vibrating action is repeatedly performed, then it eventually becomes necessary to perform dummy ejection, also known as purging, before reaching a state where ejection has become impossible.

If the ink viscosity is to be restored by the purging, then it is necessary to discard the ink inside the pressure chambers 52 in a state where the ink in the whole flow channel, including the pressure chamber 52, has increased in viscosity due to the vibrating action as described above.

In FIG. 12C, the first line 911 indicates the initial solvent concentration distribution (in other words, the distribution where the average value of the solvent concentration of the ink from the common flow channel 955 to the nozzle 51 is the initial concentration A), the second line 912 indicates the solvent concentration distribution after a prescribed time period t1 has elapsed, and the third line 913 indicates the solvent concentration distribution after a time period t2 (>t1) has elapsed. As shown by the lines 911, 912 and 913 indicating these solvent concentration distributions, with the passage of time, the solvent concentration of the ink in the pressure chamber 52 falls more slowly (in other words, the ink viscosity rises more slowly) than in the nozzle 51; however, if the ink of unsatisfactory solvent concentration is to be discarded by purging in order that normal ejection can be achieved, then not only the ink inside the nozzle 51, but also the ink inside the pressure chamber 52 must inevitably be discarded. In other words, it is necessary to discard an amount of ink corresponding to an obliquely shaded region 902 which indicates the purging volume in FIG. 12C.

In particular, if it seeks to arrange a plurality of nozzles 51 at high density, then the volume of the pressure chambers 52 becomes smaller. In this state, if the vibrating action is continued, then the ink inside the pressure chamber 52 rapidly increases in viscosity. Therefore, the purging interval becomes shorter. Furthermore, ink of a volume that is directly proportional to the number of nozzles must be discarded.

Here, the issue of the purging process in a liquid ejection apparatus in the related art is described in more detail with reference to FIG. 13. In FIG. 13, the horizontal axis denotes time t, and the vertical axis denotes the solvent concentration of the ink at a position 920 in the nozzle 51 shown in FIG. 12A, which position is distant from the free surface of the ink and in the proximity of the pressure chamber 52. The first line 921 shows the temporal change of the solvent concentration of the ink at the position 920 in a case where the vibrating action is performed and purging is not performed, the second line 922 shows the temporal change of the solvent concentration of the ink at the position 920 in a case where the vibrating action and the purging are performed, and the third line 923 shows the temporal change of the solvent concentration of the ink which can be restored by the purging. If the vibrating action is performed repeatedly from the solvent concentration A in the initial state (t=0) immediately after ejection, then as stated above, the solvent concentration of the ink falls (P0 to P1), and therefore, immediately before the solvent concentration reaches the limit solvent concentration E at which normal ejection is still possible, for example, when the solvent concentration has fallen to a threshold value $th_E$ in the vicinity of the limit solvent concentration E, the purging is performed. When the purging is performed, the solvent concentration of the ink is restored (P1 to P2). Subsequently, the vibrating action and the purging are repeated continuously (P2 through P9). Since it is necessary to perform the purging repeatedly in this way, then an amount of ink corresponding to the purging volume 902 shown in FIG. 12C is repeatedly discarded from each nozzle 51. Furthermore, since there is a gradual decline in the level to which the solvent concentration of the ink can be restored by the purging, as indicated by the third line 923, then it is also necessary to re-initialize the solvent concentration of the ink by performing a more fundamental maintenance operation, such as suctioning (P9 to P110). During purging or during a maintenance operation, it is not possible to perform ejection for its original purpose. In other words, a waiting time arises during which it is not possible to perform printing. Furthermore, suctioning generally requires longer time than purging.

SUMMARY OF THE INVENTION

The present invention has been contrived in view of the foregoing circumstances, an object thereof being to provide a liquid ejection apparatus and a control method for a liquid ejection apparatus, whereby the evaporated volume of liquid at the free surface in the nozzle can be reduced, while also suppressing the consumption of the liquid due to purging, and the like.

In order to attain the aforementioned object, the present invention is directed to a liquid ejection apparatus, comprising: a nozzle which ejects liquid; a pressure chamber which is connected to the nozzle; an actuator which generates pressure applied to the liquid inside the pressure chamber, the actuator driving liquid ejection for ejecting the liquid from the nozzle, the actuator driving vibrating action to the liquid for causing a free surface of the liquid in the nozzle to vibrate to an extent that does not eject the liquid from the nozzle; a viscosity state judgment device which judges viscosity states of the liquid in a vicinity of the free surface of the liquid in the nozzle, the viscosity states including a first state in which the liquid ejection from the nozzle is possible and the vibrating action is not required for the nozzle, a second state in which the liquid ejection from the nozzle is possible and the vibrating action is required for the nozzle, and a third state in which the liquid ejection from the nozzle is not possible and restoration to the first state is possible if the vibrating action is performed for the nozzle; and a control device which, in a case where the liquid ejection from the nozzle is to be performed, controls in the first state so as to perform the liquid ejection from the nozzle without performing the vibrating action for the nozzle, and controls in either one of the second state and the third state so as to perform the liquid ejection from the nozzle after performing the vibrating action for the nozzle, and which, in a case where the liquid ejection from the nozzle is not to be performed, controls in either one of the first state and the second state so as not to perform the vibrating action for the nozzle, and controls in the third state so as to perform the vibrating action for the nozzle.

According to this aspect of the present invention, in cases where the liquid is to be ejected from the nozzle, according to requirements, the viscosity of the liquid in the vicinity of the free surface in the nozzle is restored by the vibrating action, whereupon the liquid ejection is performed, and in cases where the liquid is not to be ejected from the nozzle, the frequency of the vibrating action is restricted. Therefore, the evaporation volume at the free surface of the liquid in the nozzle is suppressed, and hence the frequency of purging (dummy ejection) is lowered, the liquid volume required for each purging operation is reduced, and the consumption of the liquid can be restricted. Moreover, even if the frequency of purging or suctioning is reduced, the viscosity at the free surface of the liquid can still be restored over a long period of time, and hence the intervals between purging operations and suctioning operations can be made very long indeed. Therefore, productivity in printing onto a recording medium is improved. Furthermore, the number of vibrating actions is also reduced, thus saving energy, as well as extending the life of the actuator.

In order to attain the aforementioned object, the present invention is also directed to a liquid ejection apparatus, comprising: a nozzle which ejects liquid; a pressure chamber which is connected to the nozzle; an actuator which generates pressure applied to the liquid inside the pressure chamber, the actuator driving liquid ejection for ejecting the liquid from the nozzle, the actuator driving vibrating action to the liquid for causing a free surface of the liquid in the nozzle to vibrate to an extent that does not eject the liquid from the nozzle; a viscosity state judgment device which judges a viscosity state of the liquid in a vicinity of the free surface of the liquid in the nozzle; and a control unit which, in a case where the liquid ejection from the nozzle is to be performed, controls so as to perform the vibrating action using the actuator before the viscosity state of the liquid in the vicinity of the free surface has reached a state where the liquid ejection from the nozzle is impossible and then controls so as to perform the liquid ejection using the actuator, and which, in a case where the liquid ejection from the nozzle is not to be performed, controls so as to restrict a frequency of the vibrating action even if the viscosity state of the liquid in the vicinity of the free surface has reached the state where the liquid ejection from the nozzle is impossible while the viscosity state of the liquid in the vicinity of the free surface is able to be restored by the vibrating action.

According to this aspect of the present invention, in cases where the liquid is to be ejected from the nozzle, the viscosity of the liquid in the vicinity of the free surface in the nozzle is restored by the vibrating action, whereupon the liquid ejection is performed, and in cases where the liquid is not to be ejected from the nozzle, then the frequency of the vibrating action is restricted, even if the liquid has reached an increased viscosity state where ejection of the liquid is impossible, while the viscosity of the liquid in the vicinity of the free surface in the nozzle can still be restored by the vibrating action. Therefore, the evaporation volume at the free surface of the liquid in the nozzle is minimized, and hence the frequency of purging (dummy ejection) becomes extremely low, the liquid volume required for each purging operation is reduced, and the consumption of the liquid is restricted. Moreover, even if the frequency of purging or suctioning is reduced, the viscosity at the free surface of the liquid can still be restored over a long period of time, and hence the intervals between purging operations and suctioning operations can be made very long indeed. Therefore, productivity in printing onto a recording medium is improved. Furthermore, the number of the vibrating actions is also reduced, thus saving energy, as well as extending the life of the actuator.

Preferably, the viscosity state judgment device performs determination of at least one of an evaporation volume and a solvent concentration of the liquid at the free surface in the nozzle, and judges the viscosity state according to the determination.

According to this aspect of the present invention, it is possible accurately to judge the viscosity state of the liquid in the vicinity of the free surface in the nozzle, on the basis of the evaporation volume or the solvent concentration of the liquid at the free surface.

Preferably, the viscosity state judgment device judges the viscosity state according to an evaporation condition including at least one of temperature in a vicinity of the nozzle, humidity in the vicinity of the nozzle, a vapor pressure of solvent of the liquid, a history of the vibrating action for the nozzle, and a history of the liquid ejection from the nozzle.

Preferably, the liquid ejection apparatus further comprises: a storage device which stores information indicating a relationship between the evaporation condition and the viscosity state in a form of one of a formula and a table, wherein the viscosity state judgment device judges the viscosity state according to the information stored in the storage device.

Preferably, the viscosity state judgment device judges the viscosity state according to an evaporation condition including at least one of a volume of the pressure chamber, an opening surface area of the nozzle, a shape of a flow channel leading from the pressure chamber to the nozzle, efficiency of liquid churning achieved by the vibrating action, a vibrating amount of the vibrating action, properties of the liquid, temperature of the liquid, a drive force of the actuator, and a relative speed of the nozzle and a recording medium.

Preferably, the liquid ejection apparatus further comprises: a pressure sensor which measures internal pressure of at least one of the pressure chamber, a flow channel leading from the pressure chamber to the nozzle, and the nozzle, wherein the viscosity state judgment device judges the viscosity state according to the internal pressure measured by the pressure sensor.

Preferably, the liquid ejection apparatus further comprises: a concentration sensor which measures a concentration of the liquid in the vicinity of the free surface, wherein the viscosity state judgment device judges the viscosity state according to the concentration measured by the concentration sensor.

In order to attain the aforementioned object, the present invention is also directed to a control method for a liquid ejection apparatus, comprising the steps of: judging viscosity states of liquid in a vicinity of a free surface of the liquid in a nozzle which ejects the liquid, the viscosity states including a first state in which liquid ejection from the nozzle is possible and vibrating action is not required for the nozzle, a second state in which the liquid ejection from the nozzle is possible and the vibrating action is required for the nozzle, and a third state in which the liquid ejection from the nozzle is not possible and restoration to the first state is possible if the vibrating action is performed for the nozzle; in a case where the liquid ejection from the nozzle is to be performed, performing the liquid ejection from the nozzle without performing the vibrating action for the nozzle in the first state, and performing the liquid ejection from the nozzle after performing the vibrating action for the nozzle in either one of the second state and the third state; and in a case where the liquid ejection from the nozzle is not to be performed, not performing the vibrating action for the nozzle in either one of the first state and the second state, and performing the vibrating action for the nozzle in the third state.

In order to attain the aforementioned object, the present invention is also directed to a control method for a liquid ejection apparatus, comprising the steps of: judging a viscosity state of liquid in a vicinity of a free surface of the liquid in a nozzle which ejects the liquid; in a case where liquid ejection from the nozzle is to be performed, performing vibrating action using before the viscosity state of the liquid in the vicinity of the free surface has reached a state where the liquid ejection from the nozzle is impossible and then performing the liquid ejection; and in a case where the liquid ejection from the nozzle is not to be performed, restricting a frequency of the vibrating action even if the viscosity state of the liquid in the vicinity of the free surface has reached the state where the liquid ejection from the nozzle is impossible while the viscosity state of the liquid in the vicinity of the free surface is able to be restored by the vibrating action.

According to the present invention, it is possible to reduce the evaporation volume at the free surface of the liquid in the nozzle, as well as suppressing the consumption of liquid by reducing the frequency of purging and suctioning.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Image Forming Apparatus

Figure 1:
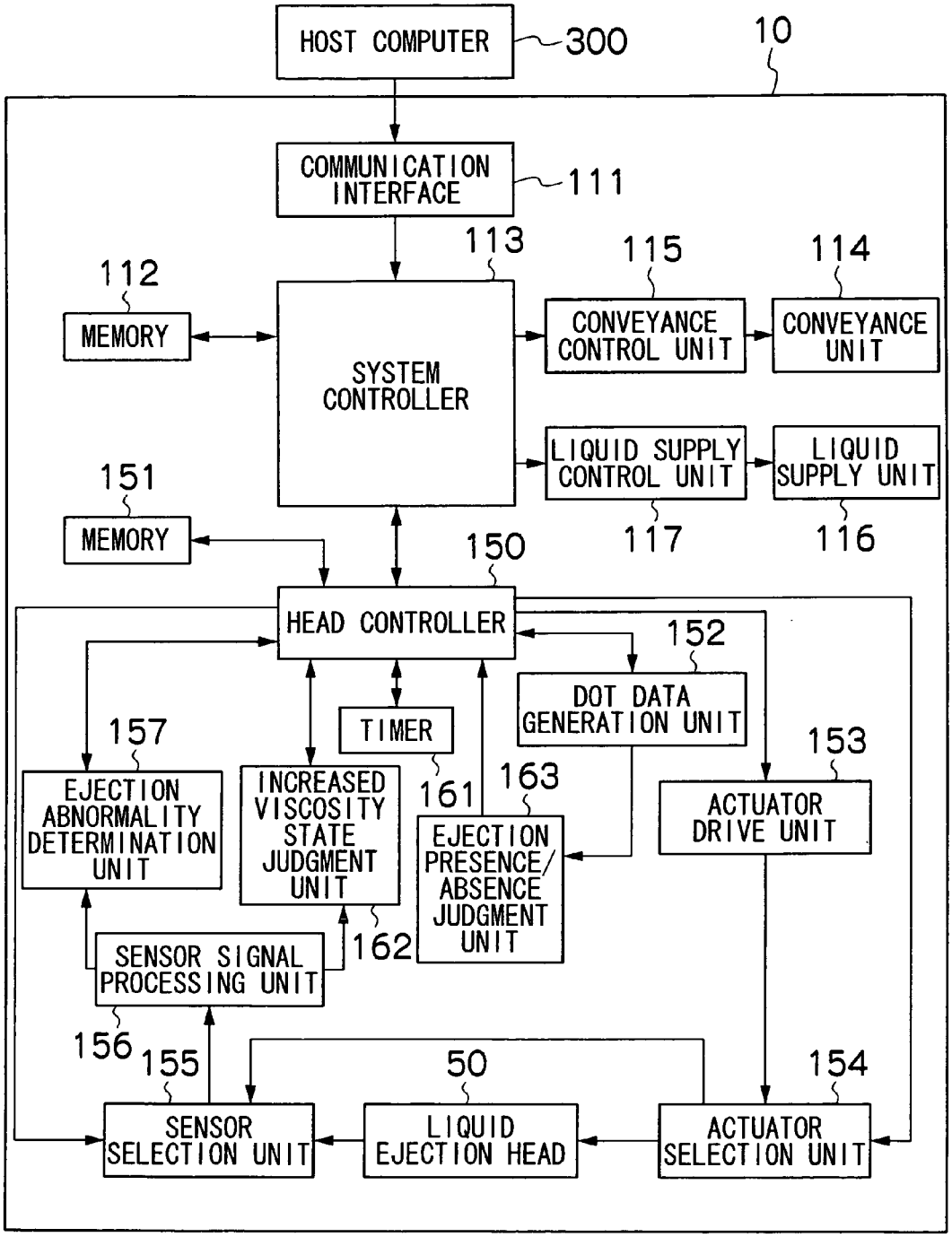
FIG. 1 is a block diagram showing the general composition of an image forming apparatus according to an embodiment of the present invention.

FIG. 1 is a block diagram showing the general composition of an image forming apparatus corresponding to a liquid ejection apparatus according to an embodiment of the present invention.

The image forming apparatus 10 shown in FIG. 1 comprises: a communication interface 111; memories 112 and 151; a system controller 113; a conveyance unit 114; a conveyance control unit 115; a liquid supply unit 116; a liquid supply control unit 117; a head controller 150; a dot data generation unit 152; an actuator drive unit 153; an actuator selection unit 154; a sensor selection unit 155; a sensor signal processing unit 156; an ejection abnormality determination unit 157; a timer 161; an increased viscosity state judgment unit 162; and an ejection presence/absence judgment unit 163.

The communication interface 111 is an image data input device for receiving image data transmitted by a host computer 300. For the communication interface 111, a wired, such as a USB (Universal Serial Bus), IEEE 1394, or the like, or wireless interface can be used.

Image data sent from the host computer 300 is read into the image forming apparatus 10 through the communication interface 111, and is stored temporarily in the memory 112 for system control.

The image data input mode is not particularly limited to the image data input by means of communications with the host computer 300. For example, it is also possible to input image data to the image forming apparatus 10 by reading in image data from a removable medium, such as a memory card or optical disk.

The system controller 113 is constituted by a microcomputer and peripheral circuits thereof, and the like, and it forms a main control device which controls the whole of the image forming apparatus 10 in accordance with a prescribed program. In other words, the system controller 112 controls the respective sections, such as the communication interface 111, the system control member 112, the conveyance control unit 115, the liquid supply control unit 117, and the head controller 150.

The conveyance unit 114 conveys a recording medium, such as paper, along a prescribed conveyance path. For example, the conveyance unit 114 comprises a conveyance belt on which the recording medium is mounted by suction, and a conveyance roller and conveyance motor which drive the conveyance belt.

The conveyance control unit 115 is a driver (drive circuit) which drives the conveyance unit 114 in accordance with instructions from the system controller 113.

The conveyance unit 114 is controlled by the conveyance control unit 115, and it causes the recording medium and liquid ejection heads 50 to move relatively with respect to each other, in the direction of conveyance of the recording medium (the sub-scanning direction).

The liquid supply unit 116 supplies ink to the liquid ejection heads 50. The liquid supply unit 116 has channels which lead to the liquid ejection heads 50 from ink tanks, such as ink cartridges, installed detachably in the image forming apparatus 10, and pumps and the like.

The liquid supply control unit 117 controls the liquid supply unit 116 in accordance with instructions from the system controller 113, thereby supplying ink from the ink storage section, such as the ink cartridges, to the liquid ejection heads 50.

The head controller 150 is constituted by a microcomputer, and peripheral circuits thereof, and the like, and it controls the various processes, such as ejection of ink by the liquid ejection heads 50, vibrating action to a free surface of the ink (described hereinafter), maintenance operations (described hereinafter), creation of various historical information, and the like, in accordance with a prescribed program and instructions from the system controller 113.

The dot data generation unit 152 generates dot data from the image data, in accordance with instructions from the head controller 150. The image data is input to the image forming apparatus 10, by means of the communication interface 111, or the like, and is stored in the memory 112. The dot data is data which indicates the arrangement of dots that are to be deposited on the recording medium, and the like. If the dot size is variable, then the dot data also indicates the size of the dots to be deposited, as well as the dot arrangement. The dot data thus generated is stored in the head control memory 151.

The actuator drive unit 153 generates prescribed drive signals, which are supplied to the actuators 58 of the liquid ejection heads 50, in accordance with instructions from the head controller 150. The drive signals thus generated are output to the actuator selection unit 154.

The head controller 150 selects an actuator to which the drive signal is to be supplied, from all of actuators 58 (shown in FIG. 3 described below) arranged two-dimensionally inside the liquid ejection heads 50, on the basis of the dot data generated by the dot data generation unit 152, and the head controller 150 generates an actuator selection signal indicating the actuator 58 to which the drive signal is to be applied. The actuator selection signal thus generated is output to the actuator selection unit 154. The actuator selection signal is supplied to the actuator selection unit 154, in synchronism with the drive signal generated by the actuator drive unit 153.

The actuator selection unit 154 comprises a switching circuit. The actuator selection unit 154 selects the actuator 58 and supplies the drive signal generated by the actuator drive unit 153 to same, on the basis of the actuator selection signal output from the head controller 150.

The actuator 58 of the liquid ejection head 50 to which the drive signal is supplied from the actuator selection unit 154 causes the ink to be ejected from the nozzle 51 (shown in FIGS. 2 and 3 described below) of the liquid ejection heads 50.

In parallel with this ejection of ink toward the recording medium by the liquid ejection heads 50, the head controller 150 selects a pressure sensor 70 to perform pressure measurement for detecting ejection abnormalities, from all of pressure sensors 70 (shown in FIG. 3 described below), which are arranged in a two-dimensional configuration inside the liquid ejection heads 50, on the basis of dot data generated by the dot data generation unit, and the head controller 150 generates a sensor selection signal indicating the selected pressure sensor 70. The generated sensor selection signal is output to the sensor selection unit 155.

The sensor selection unit 155 comprises a switching circuit. The sensor selection unit 155 selects the pressure sensor 70 on the basis of the sensor selection signal output from the head controller 150. The pressure sensors 70 in the liquid ejection heads 50 measure the internal pressure of the corresponding pressure chambers 52 (shown in FIGS. 2 and 3 described below) and output pressure measurement signals.

The sensor selection unit 155 outputs the pressure measurement signal obtained by the selected pressure sensor 70, to the sensor signal processing unit 156.

The pressure measurement signal processed by the sensor signal processing unit 156 is then stored in the head control memory 151, as pressure measurement data.

The ejection abnormality determination unit 157 judges whether or not ejection has been performed normally from the nozzle 51 corresponding to the pressure chamber 52 that is the object of pressure measurement, on the basis of the pressure measurement data stored in the memory 151. The result of this judgment by the ejection abnormality determination unit 157 is transmitted to the system controller 113, via the head controller 150.

The timer 161 measures various time periods, such as the time relating to ejection of ink, the time relating to the vibrating action to the free surface of the ink, described hereinafter, and the time relating to maintenance operations, such as purging or suctioning, also described hereinafter. For example, for each of the nozzles 51 on the liquid ejection head 50, the elapsed time after the ejection, the ejection interval, the elapsed time after the vibrating action to the free surface of the ink in the nozzle 51, the vibrating action interval, the elapsed time after the maintenance operation of the liquid ejection head 50, and the maintenance operation interval, are measured. The vibrating action to the free surface of the ink and maintenance operations are described in detail below.

On the basis of the measured time periods, the head controller 150 or the system controller 113 creates ejection history information, vibrating action history information and maintenance operation history information, and it stores the information in the memories 151 and 112.

The increased viscosity state judgment unit 162 judges a state of increased viscosity in the vicinity of the free surface of the ink in each nozzle 51 of the liquid ejection heads 50. More specifically, the increased viscosity state judging unit 162 according to the present embodiment determines at least one of the evaporated volume, the solvent concentration and the viscosity, of the ink at the free surface in the nozzle, and it judges an increased viscosity state on the basis of the determined values. Here, the ink includes a coloring material and a solvent, and it is the solvent that evaporates from the free surface of the ink. The mode of judging a state of increased viscosity is described in detail hereinafter.

The ejection presence/absence judging section 163 judges the presence or absence of ejection, for each of the nozzles 51 on the liquid ejection head 50. More specifically, the ejection presence/absence judging unit 163 in the present embodiment predicts the presence or absence of ejection, before ejection actually occurs, for each nozzle in the liquid ejection head 50, on the basis of the dot data generated by the dot data generation unit 152.

Structure of Liquid Ejection Head

Figure 2:
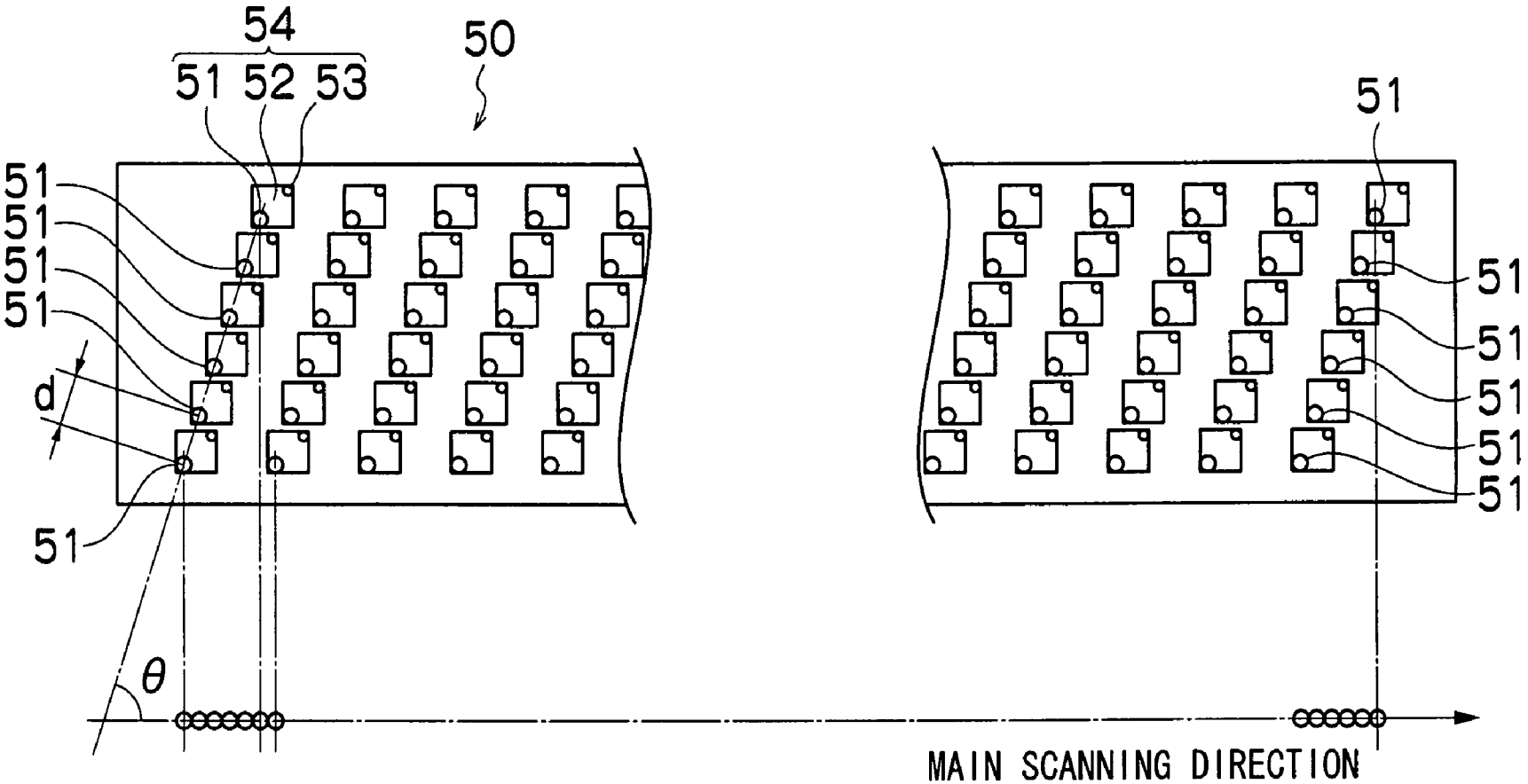
FIG. 2 is a plan view perspective diagram showing an approximate view of an embodiment of the general structure of a liquid ejection head.

FIG. 2 is a plan view perspective diagram showing an approximate view of an embodiment of the general structure of the liquid ejection head 50.

In FIG. 2, the liquid ejection head 50 comprises a plurality of pressure chamber units 54 arranged in a two-dimensional configuration, each pressure chamber unit 54 having the nozzle 51 (ejection port) which ejects ink toward a recording medium, such as paper, a pressure chamber 52, which is connected to the nozzle 51, and an ink supply flow channel 53 forming an opening section through which ink is supplied to the pressure chamber 52. In FIG. 2, in order to simplify the drawing, a portion of the pressure chamber units 54 is omitted from the drawing.

The nozzles 51 are arranged in the form of a two-dimensional matrix, following two directions: a main scanning direction (in the present embodiment, the direction substantially perpendicular to the conveyance direction of the recording medium); and an oblique direction forming a prescribed angle of θ with respect to the main scanning direction. More specifically, by arranging the nozzles 51 at a uniform pitch of d in the oblique direction forming the uniform angle of θ with respect to the main scanning direction, it is possible to treat the nozzles 51 as being equivalent to the nozzle arranged at a prescribed pitch ($d \times \cos\theta$) in a straight line in the main scanning direction. According to this nozzle arrangement, it is possible to achieve a composition which is substantially equivalent to a high-density nozzle arrangement that reaches 2400 nozzles per inch in the main scanning direction, for example. In other words, a high density is achieved for the effective nozzle pitch (projected nozzle pitch) obtained by projecting the nozzles to a straight line aligned with the lengthwise direction of the liquid ejection head 50 (main scanning direction). The nozzle arrangement following two directions as shown in FIG. 2 is called a two-dimensional matrix nozzle arrangement.

Furthermore, the plurality of pressure chambers 52 connected in a one-to-one correspondence with the nozzles 51 are arranged in a two-dimensional matrix configuration, similarly to the nozzles 51.

In implementing the present invention, the arrangement structure of the nozzles 51, and the like, is not limited in particular to the embodiment shown in FIG. 2. For example, it is also possible to compose a liquid ejection head having nozzle rows of a length corresponding to the full width of the recording medium, by joining together, in a staggered matrix arrangement, a number of short liquid ejection head blocks, in each of which a plurality of nozzles 51 are arranged two-dimensionally.

By means of the nozzle arrangement shown in FIG. 2, it is possible to compose a full line type liquid ejection head having a row of nozzles covering a length corresponding to the full width of the recording medium in the main scanning direction (the direction substantially perpendicular to the conveyance direction of the recording medium).

Figure 3:
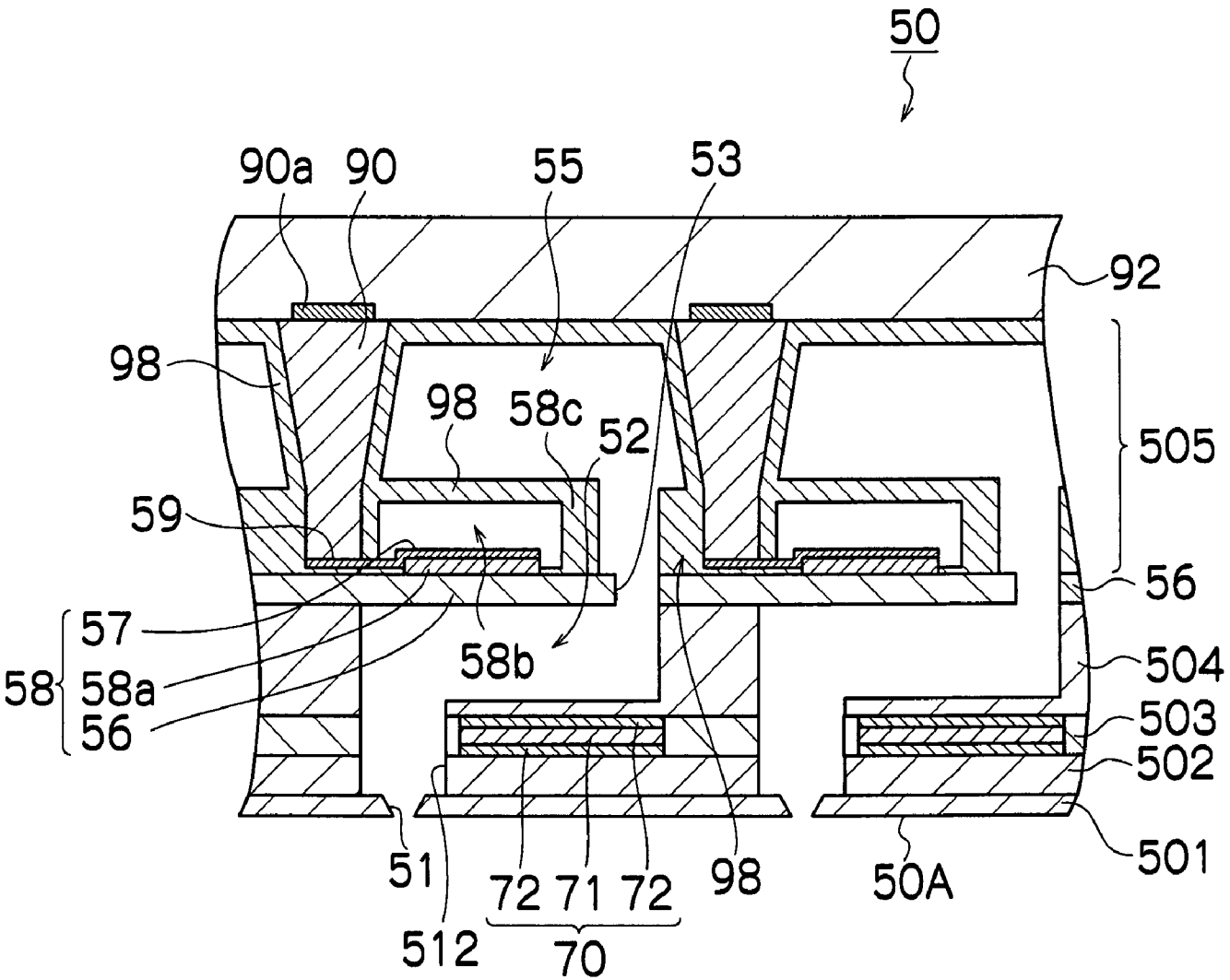
FIG. 3 is a cross-sectional diagram showing an embodiment of the internal structure of the liquid ejection head.

FIG. 3 shows a cross-section of a portion of the liquid ejection head 50 in FIG. 2, cut in a perpendicular direction to the nozzle surface 50A.

In FIG. 3, the liquid ejection head 50 is laminated from a plurality of plates 501, 502, 503, 504, 56, 505 and 92.

A nozzle connection plate 502 in which a plurality of ejection flow channels 512 connected respectively to the nozzles 51 are formed, is bonded on a nozzle plate 501 in which the nozzles 51 (ejection ports) are formed in the two-dimensional matrix configuration. The nozzle connection plate 502 is made of stainless steel, for example.

A pressure sensor plate 503 formed with the pressure sensors 70 is bonded on the nozzle connection plate 502.

The pressure sensors 70 are each constituted by arranging a piezoelectric body layer 71 for pressure measurement made of a piezoelectric material, such as PVDF (polyvinylidene fluoride) (hereinafter, referred to simply as "piezoelectric body"), between electrode layers 72 made of a conductive material, such as metal (hereinafter, referred to simply as "electrodes"), in the thickness direction of the piezoelectric body layer 71.

The pressure measurement piezoelectric body layer 71 generates distortion in accordance with the change in the internal pressure of the pressure chamber 52 formed in a pressure chamber forming plate 504, which is described below. The electrodes 72 between which the piezoelectric body 71 is arranged are induced with an electric charge in accordance with the distortion of the piezoelectric body 71. Consequently, a voltage corresponding to the internal pressure of the pressure chambers 52 (hereinafter, called "pressure measurement signal") is output from the electrodes 72 of the pressure sensor 70. This pressure measurement signal is input to the sensor signal processing unit 156 in FIG. 1, through wires (not shown) and the sensor selection unit 155 in FIG. 1.

Although not shown in the drawing, desirably, a shielding layer is formed across an insulating layer on both surfaces of the pressure sensor 70 (the upper side and the lower side). The shield layers are earthed, and they shield the pressure sensor 70 from external electric fields.

The pressure chamber plate 504 in which the pressure chambers 52 are formed is bonded on the pressure sensor plate 503. The pressure chambers 52 are connected respectively to the nozzles 51 through the ejection flow channels 512.

A diaphragm 56 constituting the ceiling faces of the pressure chambers 52 is bonded on the pressure chamber plate 504. The diaphragm 56 also serves as a common electrode of the actuators 58 described hereinafter. Furthermore, the ink supply flow channels 53 are formed in the diaphragm 56, and the pressure chambers 52 are connected through the ink supply flow channels 53 to a common liquid chamber 55, described hereinafter, which is formed at the upper side of the pressure chambers 52 and the diaphragm 56.

Piezoelectric bodies 58*a* for generating pressure are made of a piezoelectric material, such as PZT (lead zirconate titanate), and are formed on the diaphragm 56 in regions corresponding to the pressure chambers 52, and an individual electrode 57 is formed on the upper surface of each piezoelectric body 58*a*. The diaphragm 56, which serves as the common electrode, the individual electrodes 57, and the piezoelectric bodies 58*a* sandwiched from above and below between these electrodes, constitute piezoelectric actuators 58 which deform when a voltage is applied between the diaphragm 56 and the individual electrode 57, thereby generating a pressure which is applied to the ink inside the pressure chamber 52 and changing the volume of the pressure chamber 52, and thus causing ink to be ejected from the corresponding nozzle 51. The diaphragm 56 is earthed, and in actual practice, the actuators 58 are driven by applying a drive signal output from the actuator drive unit 153 in FIG. 1, to the individual electrodes 57.

Furthermore, a gap 58*b* is provided over each of the actuators 58 comprising the diaphragm 56 (the common electrode), the piezoelectric body 58*a* and the individual electrode 57, in order to protect the whole of the actuator 58 while not to obstruct the operation of the actuator 58. The gap 58*b* is formed by providing a frame 58*c* for each of the actuators 58, in such a manner that the frame 58*c* completely covers the piezoelectric body 58*a* and the individual electrode 57 formed on the piezoelectric body 58*a*. An insulating and protective layer 98 is formed on the surface of the frame 58*c*. It is possible that the frame 58*c* is formed of the insulating and protective layer 98 alone.

One end of the individual electrode 57 extends to the outer side and an electrode pad (internal electrode pad) 59 is formed thereon. A column-shaped electrical wire (electrical column) 90 is formed perpendicularly on the electrode pad 59 in such a manner that the electrical wire 90 passes through the common liquid chamber 55.

A multi-layered flexible cable 92 is arranged on the column-shaped electrical wires 90, and wires (not shown) formed in the multi-layered flexible cable 92 are connected to the column-shaped electrical wires 90 through electrode pads (external electrode pads) 90*a*, respectively, in such a manner that electrical signals (drive signals) for driving the actuators 58 are supplied to the individual electrodes 57 of the actuators 58 by passing through the column-shaped electrical wires 90.

The space in which the column-shaped electrical wires (electrical columns) 90 are erected between the diaphragm 56 and the multi-layered flexible cable 92 forms the common liquid chamber 55 in which ink is pooled for supply to the pressure chambers 52, and since ink is filled in this space, the portions of the surfaces of the column-shaped electrical wires 90 and the multi-layered flexible cable 92, and the like, which portions make contact with the ink are formed with the insulating and protective layer 98.

In the liquid ejection head 50 of the present embodiment, the common liquid chamber 55, which is positioned on the same side of the diaphragm 56 as the pressure chambers 52 in the related art, is located on the upper side of the diaphragm 56, in other words, a rear-side supply flow channel structure is adopted in which the common liquid chamber 55 is located on the opposite side of the diaphragm 56 to the pressure chambers 52. Therefore, it is possible to increase the size of the common liquid chamber 55 and to supply ink reliably to the pressure chambers 52, and hence, high-density arrangement of the nozzles 51 can be achieved, and high-frequency driving can be performed, even in the case of the high-density arrangement.

Moreover, since the wires to the individual electrodes 57 of the actuators 58 rise up perpendicularly from the electrode pads 59 of the individual electrodes 57 and pass through the common liquid chamber 55, then it is possible to increase the density of the wires used to supply drive signals to the actuators 58.

Further, since the common liquid chamber 55 is disposed above the diaphragm 56, then the length of the ejection flow channels 512 from the pressure chambers 52 to the nozzles 51 can be made shorter than that in the related art, and therefore, even in the case of the high-density arrangement, it is possible to eject ink of high viscosity (for example, approximately 20 cP to 50 cP). Furthermore, since the common liquid chamber 55 is located above the diaphragm 56 and the common liquid chamber 55 and the pressure chambers 52 are connected directly by the ink supply flow channels 53, then rapid refilling can be achieved after ejection.

In the present embodiment, the actuator 58 is used to eject ink from the nozzle 51, as well as being used for vibrating the ink to cause the free surface of the ink in the nozzle 51 to vibrate at an amplitude and frequency of a level that do not cause the ink to be ejected. This vibrating action to the free surface of the ink may also be called meniscus vibrating action. The control processing of the vibrating action is described in detail hereinafter.

Furthermore, in the present embodiment, the pressure sensors 70 arranged on the surfaces of the pressure chambers 52 are used for ejection abnormality detection in the nozzles 51, and the pressure sensors 70 can also be used for determining the evaporation volume at the nozzles 51 (or solvent concentration determination or viscosity determination of the ink) in order to judge whether or not to perform the vibrating action.

The positions where the pressure sensors 70 are disposed are not limited to being positions below the pressure chambers 52 which are the object of pressure measurement. For example, it is also possible to arrange the pressure sensors 70 in the side walls of the pressure chambers 52. However, in order to arrange the pressure chambers 52 two-dimensionally at high density, it is more desirable to dispose the pressure sensors 70 below the pressure chambers 52, rather than disposing the pressure sensors 70 on the sides of the pressure chambers 52. Moreover, in order to achieve accurate judgment of the ejection states of the nozzles 51, desirably, the pressure sensors 70 are disposed in the vicinity of the nozzles 51, as shown in FIG. 3. The composition is not limited to one where the internal pressure of the pressure chambers 52 is measured by the pressure sensors 70, and it is also possible to adopt a composition which measures the internal pressure of the ejection flow channels 512 and/or the nozzles 51.

Furthermore, the shape of the piezoelectric body 71 of the pressure sensor 70 is not limited to being a flat plate shape. However, if the pressure sensor 70 is arranged between the pressure chamber 52 and the nozzle 51, then desirably, the distance from the pressure chamber 52 to the ejection surface of the nozzle 51 is shortened, by using a thin plate of a piezoelectric material as the piezoelectric body 71, in such a manner that the ejection response with respect to the pressure generated by the actuator 58 does not decline.

Ink Supply System and Maintenance System

Figure 4:
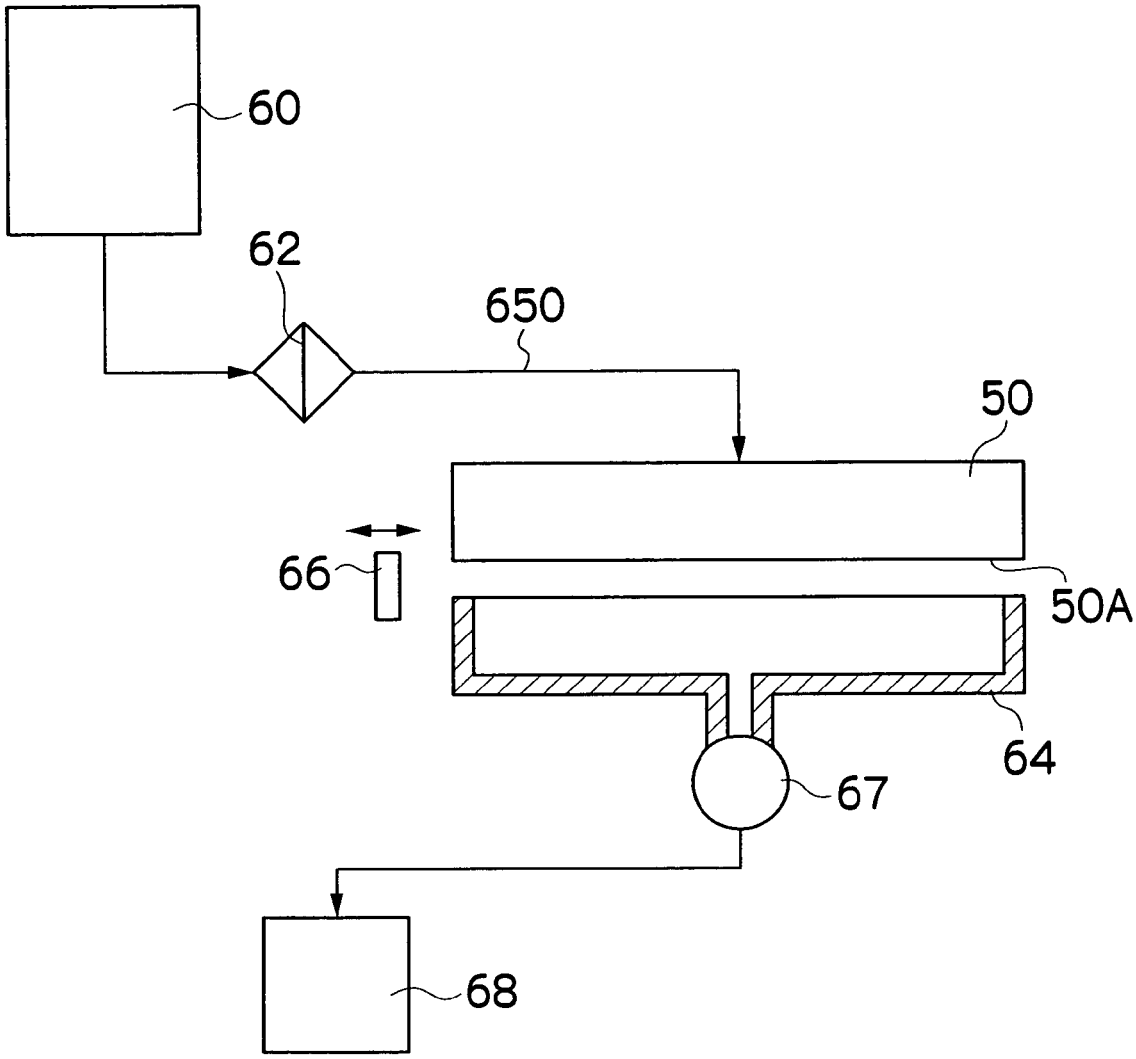
FIG. 4 is an approximate diagram showing the composition of an ink supply system and a maintenance system.

FIG. 4 is a conceptual diagram showing the composition of an ink supply system and maintenance system in the image forming apparatus 10.

An ink tank 60 is a base tank for supplying ink to the liquid ejection head 50. A filter 62 for eliminating foreign mater and bubbles is provided at an intermediate position of a tubing (ink supply channel) 650 which connects the ink tank 60 with the liquid ejection head 50.

Furthermore, the image forming apparatus 10 comprises: a cap 64 forming a device for preventing drying of the free surfaces of the ink in the nozzles 51 or preventing increase in the viscosity of the ink in the vicinity of the free surfaces during a prolonged idle duration without ejection; and a cleaning blade 66 forming a device for cleaning the nozzle surface 50A.

A maintenance unit including the cap 64 and the cleaning blade 66 can be moved relatively to the liquid ejection head 50 by a movement mechanism (not shown), and is moved from a predetermined holding position to a maintenance position below the liquid ejection head 50 as required.

The cap 64 is raised and lowered relatively to the liquid ejection head 50 by an elevator mechanism (not shown). The elevator mechanism raises the cap 64 to a predetermined elevated position so as to come into close contact with the liquid ejection head 50, and at least the nozzle region of the nozzle surface 50A is thus covered by the cap 64.

Moreover, desirably, the inside of the cap 64 is divided by means of partitions into a plurality of areas corresponding to the nozzle rows, thereby achieving a composition in which suction can be performed selectively in each of the demarcated areas, by means of a selector, or the like.

The cleaning blade 66 is composed of rubber or another elastic member, and can slide on the ink ejection surface (nozzle surface 50A) of the liquid ejection head 50 by means of a cleaning blade movement mechanism (not shown). If there are ink droplets or foreign matter adhering to the nozzle surface 50A, then the nozzle surface 50A is wiped by causing the cleaning blade 66 to slide over the nozzle surface 50A, thereby cleaning same.

A suction pump 67 suctions ink from the nozzles 51 of the liquid ejection head 50 in a state where the nozzle surface 50A of the liquid ejection head 50 is covered by the cap 64, and the suctioned ink is sent to a collection tank 68.

The suction operation is performed when ink is filled into the liquid ejection head 50 from the ink tank 60 when the ink tank 60 is installed in the image forming apparatus 10 (initial filling), and it is also performed when removing ink of increased viscosity after the image forming apparatus 10 has been out of use for a long period of time (start of use after long period of inactivity).

Here, to categorize the types of ejection performed from the nozzles 51, there is, firstly, normal ejection performed onto the recording medium in order to form an image on the recording medium, such as paper, and secondly, purging (also called dummy ejection) performed onto the cap 64, using the cap 64 as an ink receptacle.

Furthermore, if bubbles infiltrate inside the nozzles 51 and the pressure chambers 52 of the liquid ejection head 50, or if the increase in the viscosity of the ink inside the nozzles 51 exceeds a certain level, then it becomes impossible to eject the ink from the nozzles 51 in the aforementioned dummy ejection operation, and therefore, the cap 64 is made close contact with the nozzle surface 50A of the liquid ejection head 50, and an operation is performed to suction out the ink containing bubbles or the ink of increased viscosity inside the pressure chambers 52 of the liquid ejection head 50, by means of the suction pump 67.

In the image forming apparatus 10 according to the present embodiment, since the control processing of the vibrating action to the free surface of the ink described in detail below is performed, then only a very low frequency of purging or suctioning is required.

Control Processing of Vibrating Action to Free Surface of Ink

The control processing of the vibrating action to the free surface of the ink in the present embodiment is described in detail below.

The vibrating action in the present embodiment minimizes the volume of the ink solvent evaporating from the free surface of the ink in the nozzle 51 (hereinafter, called the "solvent evaporation volume"), in such a manner that increased viscosity can be minimized in the ink in the whole of the liquid ejection head 50, including the pressure chambers 52, as well as the nozzles 51.

More specifically, in order to minimize the viscosity increase in the ink, the increased viscosity state of the ink in the vicinity of the free surface in the nozzle 51 is determined on the basis of the conditions of evaporation of the ink solvent from the free surface of the ink in the nozzle 51 (evaporation conditions), and the vibrating action is performed to a minimum extent. For example, the solvent evaporation volume is estimated or actually measured, and the vibrating action is then controlled on the basis of the estimated or measured solvent evaporation volume, so as to minimize the vibrating action performed. Here, the solvent evaporation volume is correlated to the temporal change in the solvent concentration of the ink in an idle non-ejection state, and therefore the vibrating action may be controlled and minimized directly on the basis of the solvent concentration of the ink. The solvent evaporation volume is also correlated to the temporal change in the viscosity of the ink in the vicinity of the free surface in an idle non-ejection state, and therefore the vibrating action may also be controlled and minimized directly on the basis of the ink viscosity.

Here, performing the vibrating action to a minimum extent means restricting the vibrating action in such a manner that the vibrating action is not performed until the solvent concentration of the ink in the vicinity of the free surface has fallen (in other words, the ink viscosity has risen) due to evaporation of the solvent and has reached a limit solvent concentration (or ink viscosity) at which, even if the nozzle 51 has become unable to eject the ink, the nozzle 51 can be restored to a state in which normal ejection is possible (or to a state that is suitable for ejection or a state that is tolerable for ejection) by performing the vibrating action to the free surface of the ink in the nozzle 51.

The lowest solvent concentration at the limit where the ink can still be ejected, even if the viscosity of the ink in the vicinity of the free surface has risen, is hereinafter referred to as the "ejection limit concentration". Furthermore, the lowest solvent concentration at the limit where the viscosity of the ink in the vicinity of the free surface has become too high and ejection has become impossible, but where restoration to an ejectable state can be achieved by performing the vibrating action, is hereinafter referred to as the "restoration limit concentration".

In the present embodiment, the vibrating action is performed to a minimum extent, and therefore, the "restoration limit concentration" is lower than the "ejection limit concentration". In other words, the ink viscosity at the limit of possible restoration by the vibrating action is higher than the ink viscosity at the limit of possible ejection.

Figure 5:
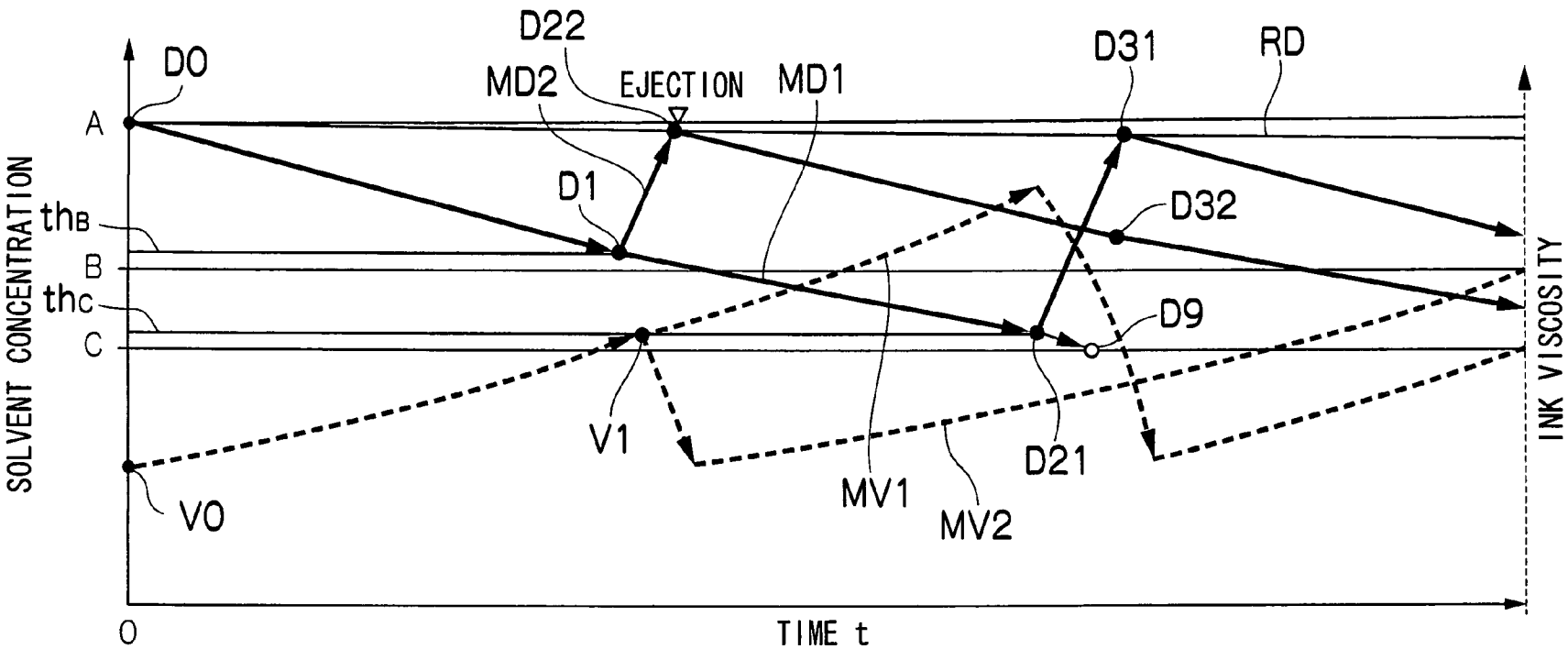
FIG. 5 is an illustrative diagram for describing control processing of vibrating action to a free surface of the ink.

FIG. 5 is an illustrative diagram used to describe the control processing of the vibrating action to the free surface of the ink according to the present embodiment.

In FIG. 5, the horizontal axis indicates time t, the left-hand vertical axis indicates the concentration of the ink solvent (solvent concentration) in the vicinity of the free surface of the ink, and the right-hand vertical axis indicates the viscosity of the ink in the vicinity of the free surface. On the left-hand vertical axis, A is the initial solvent concentration, B is the above-described "ejection limit concentration", and C is the above-described "restoration limit concentration". The first threshold value $th_B$ ($A>th_B>B$) is set to the vicinity of the ejection limit concentration B, and the second threshold value $th_C$ ($A>th_C>C$) is set to the vicinity of the restoration limit concentration C.

The solvent concentration movement lines MD1 and MD2 indicated by bold lines in FIG. 5 show the temporal change in the solvent concentration of the ink in the vicinity of the free surface. The solvent concentration at each time is obtained by projecting the corresponding time point on MD1 or MD2, onto the left-hand vertical axis. Furthermore, the ink viscosity lines MV1 and MV2 indicated by dashed lines in FIG. 5 correspond respectively to MD1 and MD2, and the ink viscosity lines MV1 and MV2 indicate the temporal change in the viscosity of the ink in the vicinity of the free surface. The ink viscosity at each time is obtained by projecting the corresponding time point on MV1 or MV2, onto the right-hand vertical axis.

Firstly, the temporal change in the solvent concentration of the ink in a case where ejection is not performed is described by means of the first solvent concentration movement line MD1 (point D0→point D1→point D21→point D31).

Figure 6:
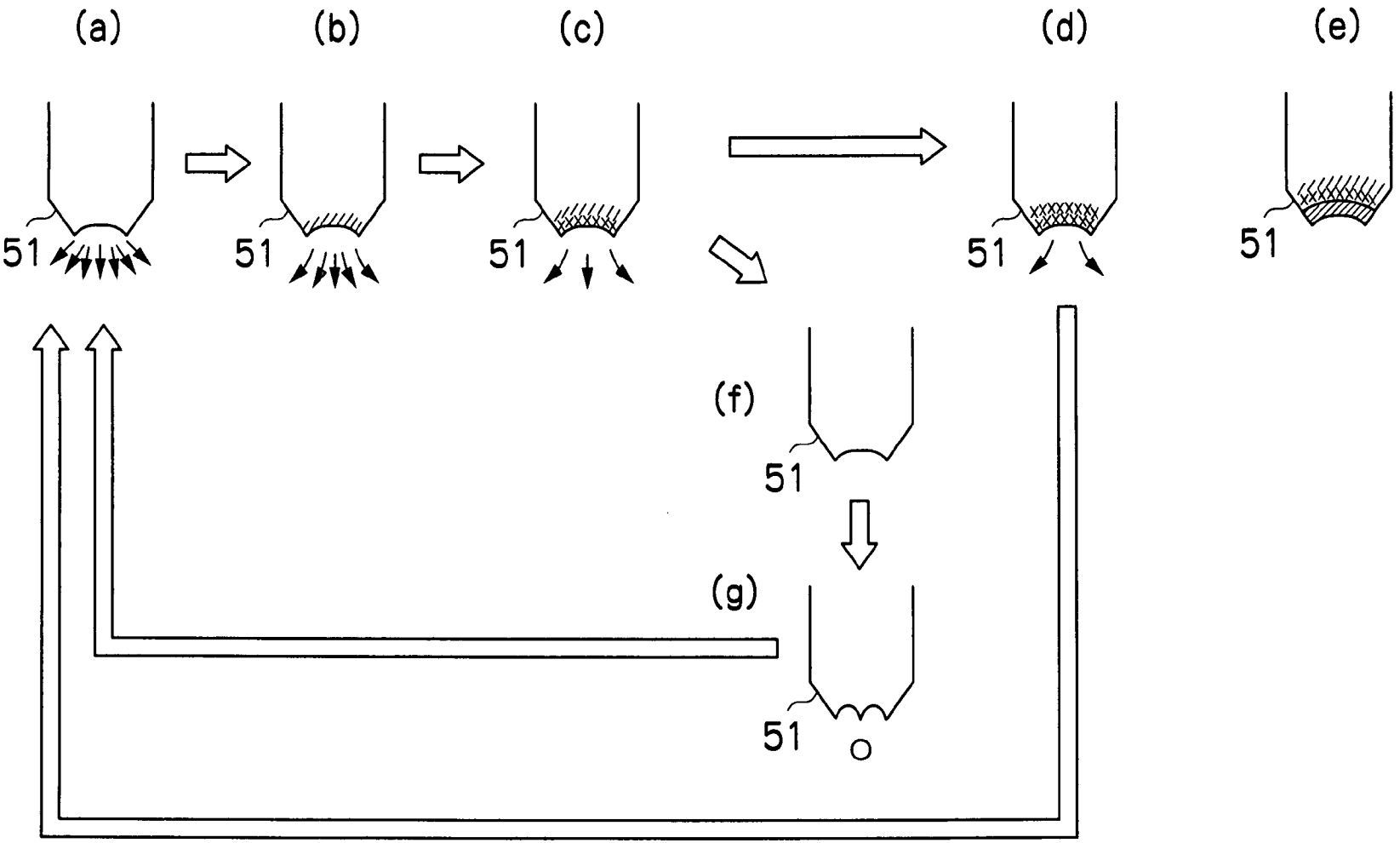
FIG. 6 is an illustrative diagram for describing increased viscosity states of ink in the vicinity of the free surface in a nozzle.

At the initial time just after ink ejection (t=0), in other words, at point D0 in FIG. 5, the ink inside the nozzle 51 has not increased in viscosity and has not solidified as a state (a) shown in FIG. 6. If the vibrating action to the free surface of the ink in the nozzle 51 is not performed, then as a state (b) shown in FIG. 6, due to the evaporation of the solvent from the free surface, the viscosity of the ink in the vicinity of the free surface increases, and as a state (c) shown in FIG. 6, the solvent evaporation volume from the free surface is reduced. In other words, the solvent concentration of the ink in the vicinity of the free surface in the nozzle 51 falls as time elapses after ejection, from point D0→point D1→point D21 in FIG. 5, and as a state (d) shown in FIG. 6, the solvent evaporation volume from the free surface of the ink in the nozzle 51 becomes small. At point D21 in FIG. 5, the nozzle 51 assumes a state where normal ink ejection cannot be performed from the nozzle 51 (a non-ejectable state), and more specifically, a state where ejection cannot be performed by the first drive waveform after an idle duration without ejection (also called "first drive"). Even in this state, at point D21, the free surface of the ink is still soft as it can be restored to a state where normal ejection is possible (an ejectable state) if the vibrating action to the free surface is performed. In other words, it is restored to a state where ejection is possible by the first drive waveform after an idle duration without ejection. If the nozzle 51 is left without performing the vibrating action, then eventually, the solvent concentration of the ink reaches point D9 in FIG. 5, and as a state (e) shown in FIG. 6, the free surface of the ink in the nozzle 51 solidifies and it is not possible to restore the nozzle 51 to an ejectable state, unless the solidified ink is removed compulsorily by a maintenance operation, such as the suctioning described above.

In the present embodiment, the vibrating action to the free surface of the ink in the nozzle 51 is not performed, in principle, even if the solvent concentration of the ink at the free surface has fallen from the initial solvent concentration A to the ejection limit concentration B, or below, as indicated by the first solvent concentration movement line MD1 passing through point D0→point D1→point D21 in FIG. 5. In other words, the vibrating action to the free surface of the ink in the nozzle 51 is restricted even if the state of the nozzle 51 passes from the initial state (a) through the states (b) and (c) and reaches the non-ejectable state (d) in FIG. 6, then provided that it is within a range that has not yet reached the state (e) where restoration is impossible. However, when the solvent concentration of the ink has fallen below the second threshold value $th_C$ (where $B>th_C>C$) previously established in the vicinity of the restoration limit concentration C, then the vibrating action is started. Upon so doing, the vibrating action causes the solvent concentration of the ink in the vicinity of the free surface to be restored to near the initial concentration A, as indicated by the first solvent concentration movement line MD1 passing through point D21→point D31 in FIG. 5. In other words, the ink in the vicinity of the free surface in the nozzle 51 is restored to a state of virtually no increase in viscosity, as changing from the state (d) to the state (a) in FIG. 6.

On the other hand, if it becomes necessary to eject ink before the solvent concentration of the ink in the vicinity of the free surface has fallen to the threshold value $th_C$ in the vicinity of the restoration limit concentration C, then the vibrating action is started, and the solvent concentration of the ink in the vicinity of the free surface is restored substantially to the initial concentration A, as shown by the second solvent concentration movement line MD2 passing through point D1→point D22 in FIG. 5, whereupon ink ejection is performed. In other words, after passing through a restoration state (f) (which corresponds to the initial state (a)) shown in FIG. 6, the nozzle 51 assumes an ejection state (g) shown in FIG. 6.

Figure 7:
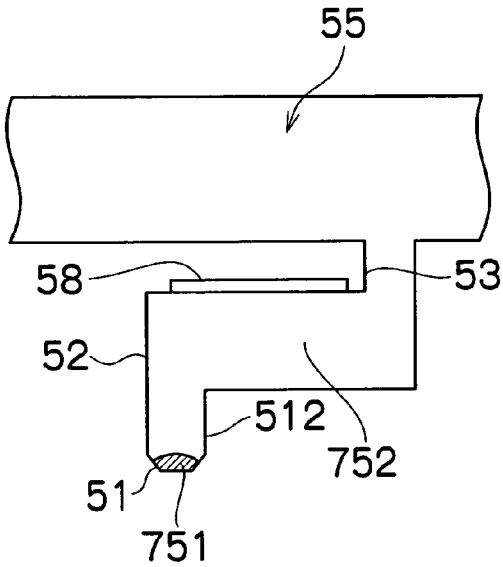
FIG. 7 is an illustrative diagram used to describe differences in the change of the increased viscosity state of the ink, in the vicinity of the free surface and inside the pressure chamber.

In the present embodiment, since the vibrating action is only performed to a minimum extent, the volume of solvent evaporating from the free surface of the ink (the solvent evaporation volume) is lower than that in the related art, and hence, as shown in FIG. 7, a concentration decrease range 751 of the ink solvent in the vicinity of the free surface of the ink is narrow. In other words, the solvent concentration gradient in the vicinity of the free surface of the ink is steep.

Since the solvent evaporation volume is kept small in this way, then the change in the solvent concentration (or the change in the viscosity) of the ink 752 inside the pressure chamber 52 is smaller than that in the related art.

Figure 8:
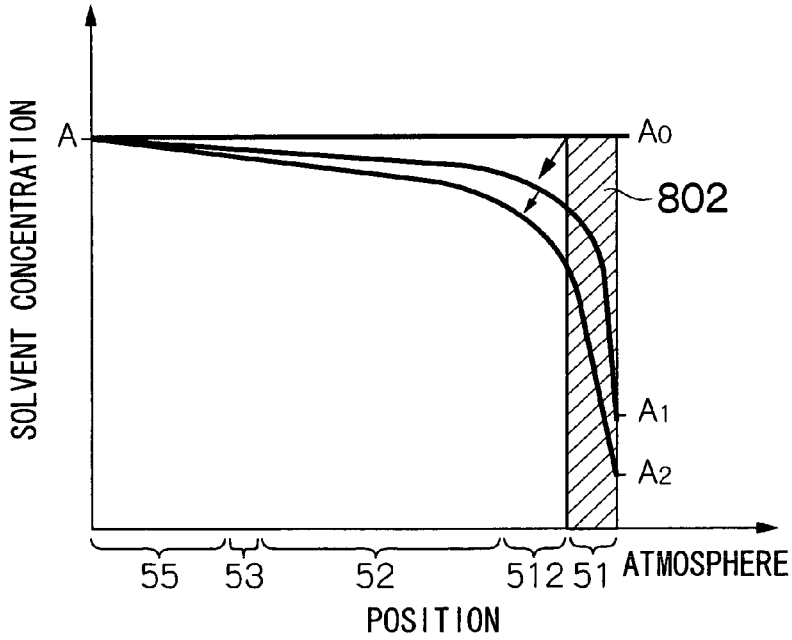
FIG. 8 is an illustrative diagram showing solvent densities of the ink at positions from the common liquid chamber to the nozzle.

More specifically, as shown in FIG. 8, as the position approaches the pressure chamber 52, the solvent concentration of the ink in the ejection flow channel 512 leading to the pressure chamber 52 less declines, and furthermore, the solvent concentration of the ink inside the pressure chamber 52 hardly declines at all. In other words, even if the vibrating action to the free surface of the ink in the nozzle 51 is not performed, there is hardly any decline in the solvent concentration of the ink in the pressure chamber 52 side of the ejection flow channel 512, the pressure chamber 52 itself, and the whole of the common liquid chamber 55 connected to these. Even if a maintenance operation, such as purging or suctioning, is performed, the volume of discarded ink is only the small amount corresponding to a region 802 indicated by the diagonal hatching in FIG. 8.

Furthermore, the solvent concentration level that can be reached by restoration through the vibrating action experiences an extremely gradual change over time, as indicated by a line RD in FIG. 5. Consequently, it is possible to achieve an extremely low frequency of maintenance operations, such as purging or suctioning.

FIG. 5 shows the embodiment of a case where the solvent concentration of the ink in the vicinity of the free surface of the ink is restored substantially to the initial concentration A by the vibrating action, but the present invention is not limited to cases of this kind, and it is also possible to restore the solvent concentration of the ink to a prescribed solvent concentration level between A and C. This shortens the vibrating action duration, for example. Also possible is a mode in which the solvent concentration of the ink is maintained in the vicinity of C (for example, at $th_C$).

Figure 12A:
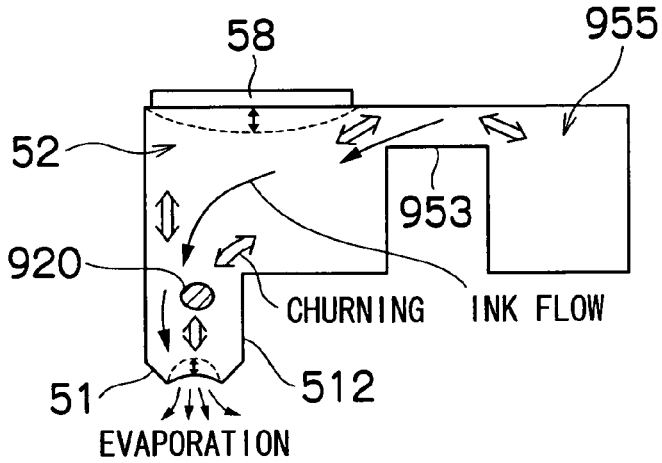
FIG.12A RELATED ART
FIGS. 12A to 12C are illustrative diagrams for describing increased viscosity of ink in a liquid ejection apparatus in the related art.
Figure 12B:
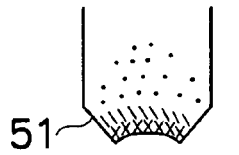
FIG.12B RELATED ART
Figure 12C:
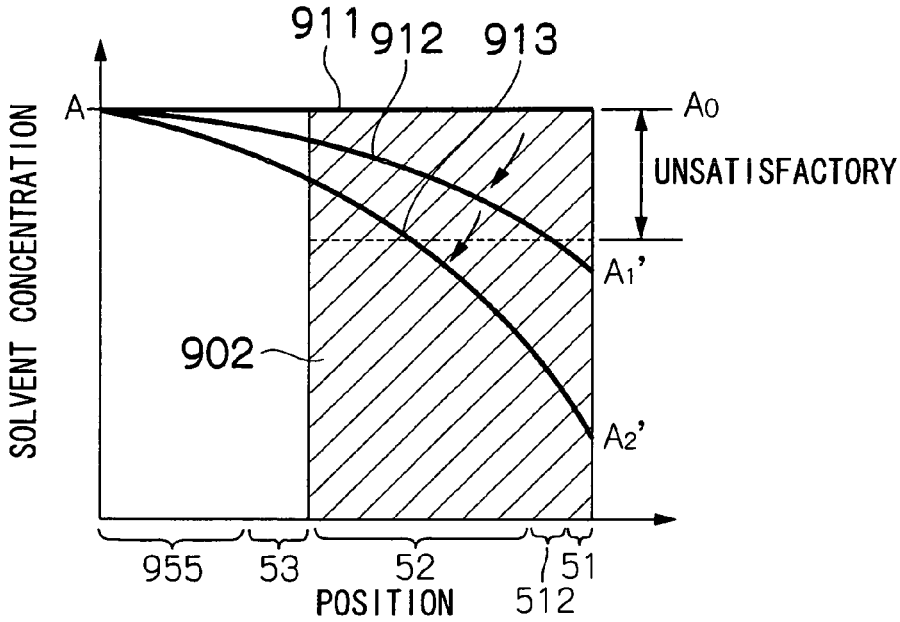
FIG.12C RELATED ART
Figure 13:
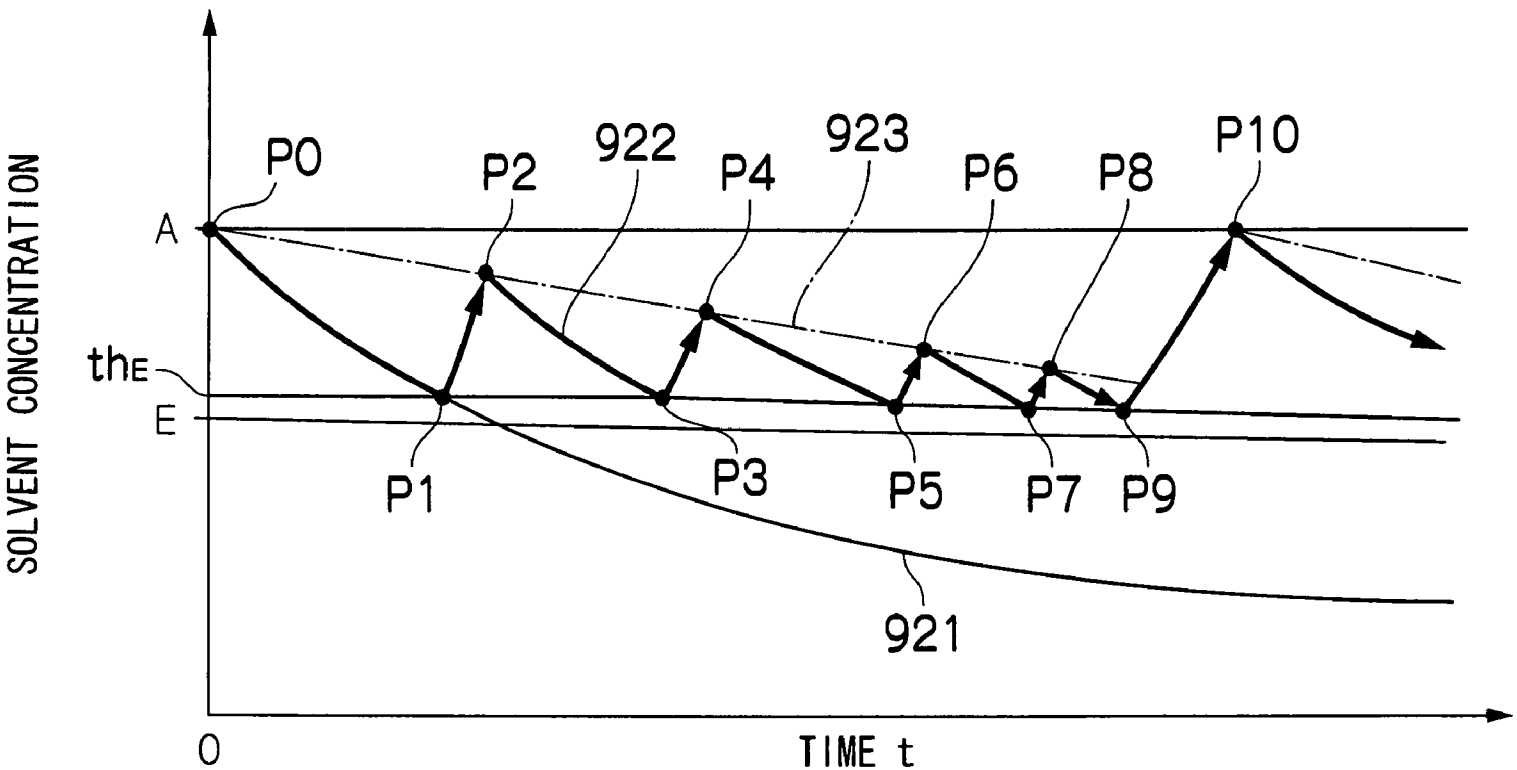
FIG.13 RELATED ART
FIG. 13 is a diagram showing temporal change in the solvent concentration of the ink subjected to vibrating action, purging and a maintenance operation in a liquid ejection apparatus in the related art.

In the related art, since the vibrating action to the free surface of the ink in the nozzle 51 is performed continually, then although the solvent concentration of the ink in the vicinity of the free surface experiences only a gradual temporal change (A0→A1'→A2' as shown in FIG. 12C), the region 902 in which the solvent concentration of the ink declines reaches into the interior of the pressure chamber 52. On the other hand, according to the embodiment of the present invention, since the vibrating action to the free surface of the ink in the nozzle 51 is restricted until the solvent concentration of the ink reaches the in FIG. 5, then although the temporal change of the solvent concentration of the ink in the vicinity of the free surface in the nozzle 51 (A0→A1→A2) is relatively sudden, the region in which the solvent concentration of the ink declines can be restricted to the narrow region 802 in the vicinity of the free surface of the ink as shown in FIG. 8. Therefore, when restoring the nozzle 51 by purging, it is possible to reduce the ink consumption volume.

The above-described control processing of the vibrating action is performed in the image forming apparatus 10 shown in FIG. 1 by the head controller 150, using the timer 161, the increased viscosity state judgment unit 162, and the ejection presence/absence judgment unit 163.

Figure 9:
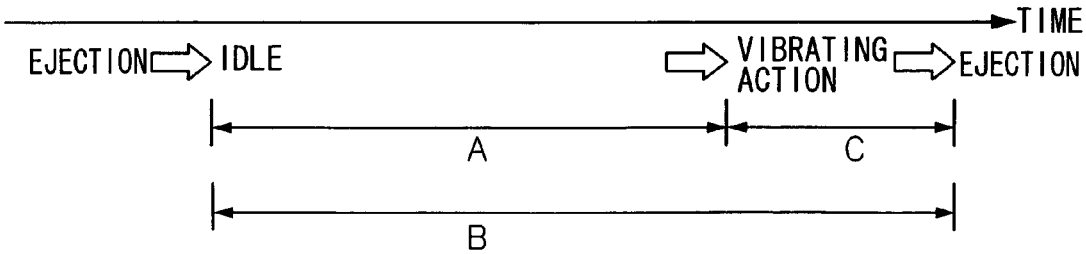
FIG. 9 is an illustrative diagram showing the relationship between an idle duration A, an ejection interval B and a vibrating action duration C.

FIG. 9 shows the relationship between the idle duration A during which neither ejection nor vibrating action is performed, the ejection interval B and the vibrating action duration C.

In the image forming apparatus 10 according to the present embodiment, the vibrating action duration C (or number of vibrating actions) is determined in accordance with the idle duration A (or the ejection interval B) and evaporation conditions, such as the temperature, humidity, solvent vapor pressure, and the like, as described in more detail below, and if it becomes necessary to eject ink from the nozzle 51, then ejection is performed after first performing the vibrating action to the free surface of the ink in the nozzle 51.

If the idle duration A (of the ejection interval B) becomes long, then in general, the vibrating action duration C also becomes long, but compared to the related art where the vibrating action to the free surface of the ink in the nozzle 51 is performed continuously through the idle duration A, there is only a small change in the solvent concentration of the ink inside the pressure chamber 52 connected to the nozzle 51, and hence the time period during which restoration can be achieved by the vibrating action becomes longer.

However, if the idle duration A (or the ejection interval B) becomes too long, then the ink in the vicinity of the free surface of the ink in the nozzle 51 solidifies to such an extent that it cannot be restored by the vibrating action, and therefore, even if ejection is not to be performed, the vibrating action is performed whenever a previously established prescribed time period or prescribed solvent evaporation volume has been exceeded.

Moreover, if it coincides with the prescribed maintenance cycle, then it is possible to perform purging instead of the vibrating action.

Depending on the ink composition, in the case of an aqueous ink having water, which evaporates readily, as a solvent, beneficial effects can be obtained from the vibrating action if the idle duration A (or the ejection interval B) exceeds 0.5 seconds.

For example, in a case where ink droplets of 2 picoliters are ejected continuously at 20 kHz and the ink inside the pressure chamber 52 is changed over every 0.2 seconds, then if non-continuous ejection is performed at a ratio of 1 time in every 2.5 times of the continuous ejection operations, the changeover time of the ink inside the pressure chamber 52 is substantially 0.5 seconds, and the ink volume expelled by ejection essentially balances with the evaporation volume of the ink solvent. Furthermore, in a case where ink droplets of 2 picoliters are ejected continuously at 40 kHz and the ink inside the pressure chamber 52 is changed over every 0.1 seconds, then if non-continuous ejection is performed at a ratio of 1 time in every 5 times of the continuous ejection operations, the changeover time of the ink inside the pressure chamber 52 is substantially 0.5 seconds, and the ink volume expelled by ejection essentially balances with the evaporation volume of the ink solvent. In actual practice, ink is ejected from the nozzle 51, where the solvent concentration of the ink is lower than that in the pressure chamber 52, and therefore, a balance between the expelled ink volume and the solvent evaporation volume is achieved at ejection of lower frequencies than those stated above. The conditions at which this balance is achieved vary depending on conditions such as the shape and dimensions of the pressure chamber 52 and the ejection flow channel 512 leading to the nozzle 51, the properties of the ink, the environmental conditions, and the like.

In other words, even if the idle duration A (or the ejection interval B) is shorter than 0.5 seconds, in the case of ejection that is less frequent than ejection achieving a balance between the solvent evaporation volume and the expelled ink volume, the solvent concentration of the ink in the pressure chamber 52 and the ejection flow channel 512 continues to decline, and in the case of the related art which performs the vibrating action to the free surface of the ink in the nozzle 51 continuously during the idle duration without ejection, purging becomes necessary at an early stage.

In the present embodiment, even if the idle duration A (or the ejection interval B) is shorter than 0.5 seconds, in the case of ejection that is less frequent than the ejection frequency achieving the aforementioned balance, desirably, the vibrating action is also controlled on the basis of the ejection interval B and the ink volume expelled by ejection.

In the case of an image forming apparatus that prints at high-speed, for example, of the speed of an A4-size recording paper at approximately 0.5 seconds per page, nozzles that perform less frequent ejection exceeding an interval of 0.5 seconds perform ejection approximately once per page, and even if there is some variation in the ejection volume of ink to form dots, the difference between the dots is not noticeable in terms of image quality. Furthermore, similarly to the foregoing, there may be some variation in the ejection volume of ink to form dots that are separated by several tens of millimeters on the recording medium, in the case of less frequent ejection having an interval of approximately 0.5 seconds, the difference between the dots is not noticeable in terms of image quality. In cases such as these, it is not necessary to continue the vibrating action toward restoration of the solvent concentration of the ink to its initial value, and therefore it is possible to halt the vibrating action once the solvent concentration of the ink has been restored to a level within a range that is tolerable according to more lenient image evaluation conditions. In so doing, it is possible to restrict the evaporation volume of the ink solvent to an extremely small amount.

Figure 10:
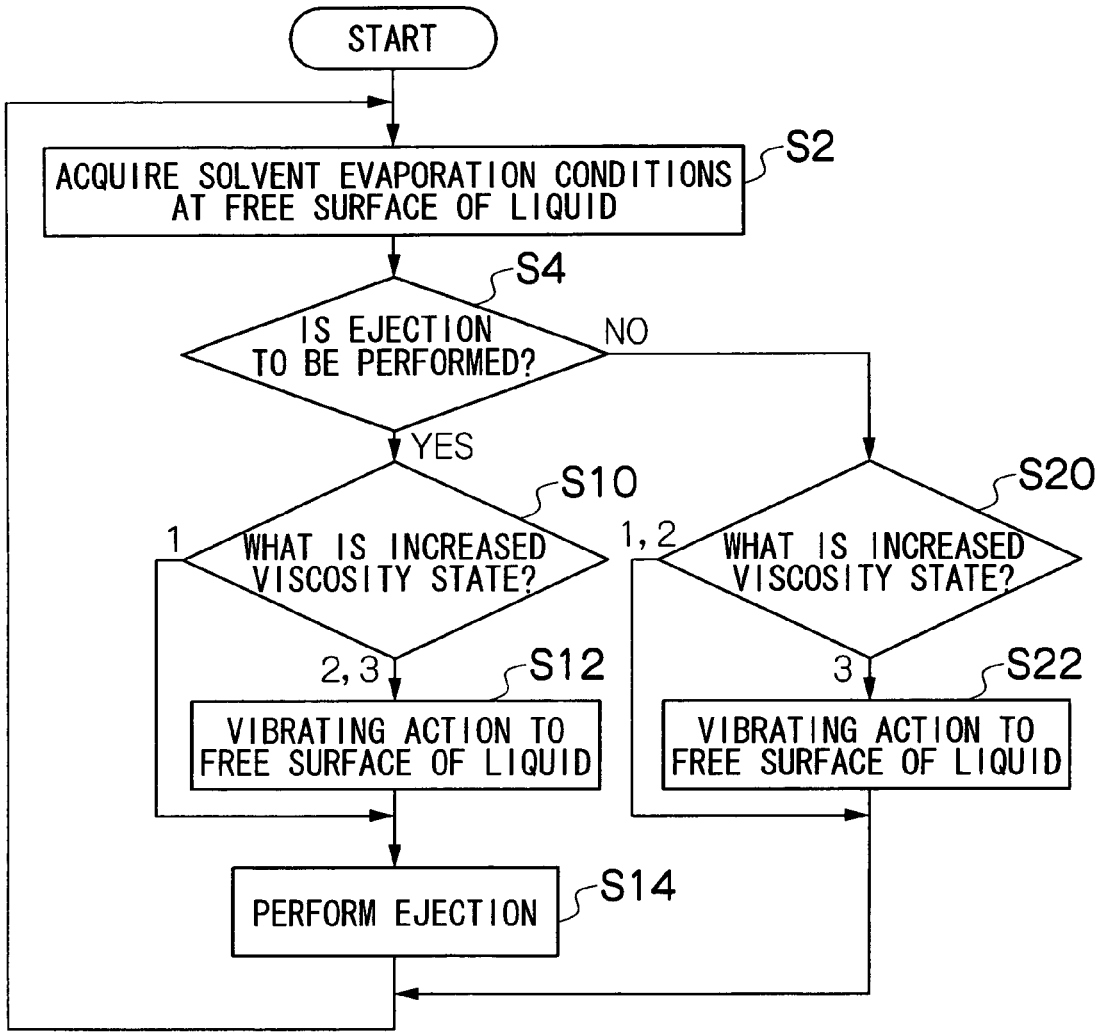
FIG. 10 is a flowchart showing the sequence of an embodiment of control processing of the vibrating action.

FIG. 10 is a flowchart showing the sequence of one basic embodiment of control processing of the vibrating action.

In FIG. 10, firstly, the evaporation conditions at the free surface of the ink are obtained for each of the nozzles 51 on the liquid ejection head 50 (S2). There are various evaporation conditions and these are described in detail hereinafter.

Next, for each of the nozzles 51 on the liquid ejection head 50, it is judged whether or not ink is to be ejected (S4). In the present embodiment, the presence or absence of ejection is predicted for each nozzle 51 on the basis of the dot data generated by the dot data generation unit 152 in FIG. 1.

Furthermore, the increased viscosity state of the ink in the vicinity of the free surface in the nozzle 51 is judged on the basis of the evaporation conditions (S10, S20).

As a specific method for judging the increased viscosity state, for example, it is possible to judge the state by calculating the solvent evaporation volume (ink evaporation volume) or the solvent concentration of the ink at the free surface in the nozzle 51.

Here, it is judged which increased viscosity state the ink is in, of a plurality of increased viscosity states, including: a first state (a normal ejectable state) where normal ink ejection is possible and the vibrating action is not necessary; a second state (ejectable and restorable state) where ink ejection is possible, but the vibrating action is required and the ink state can be restored to the first state (the normal ejectable state) by performing the vibrating action; and a third state (non-ejectable but restorable state) where ink ejection is not possible, but the ink can be restored to the first state (the normal ejectable state) by performing the vibrating action.

The normal ink ejection in the first state means that ejection can be performed by the first drive waveform after the idle duration without ejection.

In the second state, ejection is possible, but the ejection volume, ejection direction, or the like, have become abnormal, and therefore, restoration is required.

In specific terms, the increased viscosity state can be judged by calculating the solvent evaporation volume from the free surface of the ink on the basis of various evaporation conditions, such as the ambient temperature, the ambient humidity, the solvent vapor pressure, and the like, and then comparing the solvent concentration of the ink corresponding to this evaporation volume with the prescribed threshold values ($th_B$ and $th_C$ in FIG. 5). Furthermore, it is also possible to judge the increased viscosity state by calculating or directly measuring the solvent concentration of the ink, and it is also possible to judge the increased viscosity state by calculating or directly measuring the ink viscosity corresponding to the solvent evaporation volume.

More specifically, it is judged whether or not the ink is in the first increased viscosity state by measuring whether or not the flight speed of the ejected ink droplets is equal to or greater than a tolerable value, in other words, whether or not the flight speed of the ejected ink droplets is within a prescribed tolerable range, on the basis of the solvent evaporation volume.

If ink ejection is to be performed and the increased viscosity state at the free surface of the ink in the nozzle 51 is in the first state (normal ejectable state), then the ink is ejected from the nozzle 51 without performing the vibrating action (S14).

On the other hand, if ink ejection is to be performed and the increased viscosity state of the ink at the free surface in the nozzle 51 is either one of the second state (ejectable and recoverable state) or the third state (non-ejectable but recoverable state), then the vibrating action is performed (S12), thereby restoring the ink in the vicinity of the free surface to the first state (normal ejectable state), whereupon the ink is ejected from the nozzle 51 (S14). In other words, ejection is performed after restoring the viscosity of the ink in the vicinity of the free surface to a state where ejection is possible from the nozzle 51, by performing the vibrating action using the actuator 58, before it becomes impossible to eject the ink from the nozzle 51.

From the viewpoint of reducing the frequency of the vibrating action, the vibrating action is performed when it is judged that the ink has changed from the first increased viscosity state to the second increased viscosity state, when the solvent concentration of the ink in the vicinity of the free surface has fallen below the threshold value $th_B$ near the ejection limit concentration B shown in FIG. 5, due to evaporation of the ink (and more specifically, the solvent) from the free surface.

From the viewpoint of improving image quality, when the flight speed of the ejected ink droplets is less than a tolerable value, then the vibrating action is performed for a time period required for the solvent concentration of the ink to rise to a level where the flight speed of the ejected ink droplets becomes equal to or greater than the tolerable value.

If ink ejection is not to be performed, and if the increased viscosity state at the free surface of the ink is either one of the first state (normal ejectable state) or the second state (ejectable and restorable state), then the vibrating action is not performed. If ink ejection is not to be performed and the increased viscosity state at the free surface of the ink is the third state (non-ejectable but restorable state), then the vibrating action is performed (S22). Thereby, the free surface of the ink is restored to the first state (the normal ejectable state). More specifically, even if ink ejection from the nozzle 51 becomes impossible, the frequency of the vibrating action to the free surface of the ink in the nozzle 51 is restricted while the viscosity of the ink in the vicinity of the free surface can be restored by the vibrating action, and the viscosity of the ink in the vicinity of the free surface is restored to a state where ink ejection from the nozzle 51 is possible, by performing the vibrating action using the actuator 58 at a prescribed timing of restricted frequency.

From the viewpoint of reducing the frequency of the vibrating action, the vibrating action is performed when it is judged that the ink has changed from the second increased viscosity state to the third increased viscosity state, when the solvent concentration of the ink in the vicinity of the free surface has fallen below the threshold value $th_C$ near the restoration limit concentration C shown in FIG. 5, due to evaporation of the ink (and more specifically, the solvent) from the free surface.

It is possible to judge the increased viscosity state of the ink in the vicinity of the free surface on the basis of the viscosity of the ink in the vicinity of the free surface, instead of the solvent concentration of the ink in the vicinity of the free surface. Moreover, the solvent concentration and the viscosity of the ink in the vicinity of the free surface correspond to the ink evaporation volume from the free surface of the ink, and therefore, it is also possible to judge the increased viscosity state on the basis of the evaporation volume of the ink from the free surface of the ink, in other words, it is possible to judge whether or not to perform the vibrating action on the basis of the ink evaporation volume from the free surface.

Acquiring Evaporation Conditions and Judging Increased Viscosity State at Free Surface of Ink The image forming apparatus 10 according to the present embodiment controls the vibrating action by acquiring the conditions (evaporation conditions) relating to the evaporation volume of solvent of the ink from the free surface in each of the nozzles 51, in a state (idle state) after ejection of ink and before the ejection of the next ink droplet, and in an infrequent ejection state.

There are various types of evaporation conditions, and typical examples of these are given below:

Evaporation condition 1: ambient temperature (in particular, the temperature in the vicinity of the nozzle is desirable);

Evaporation condition 2: ambient humidity (in particular, the humidity in the vicinity of the nozzle is desirable);

Evaporation condition 3: solvent vapor pressure;

Evaporation condition 4: ink churning history (vibrating action history, maintenance operation history);

Evaporation condition 5: ink ejection history of the nozzle;

Evaporation condition 6: opening surface area of the nozzle;

Evaporation condition 7: ink volume (the volume of ink in the range churned by the vibrating action, or the total capacity of the range in which the ink is churned by the vibrating action, such as the ejection flow passage 512, the pressure chamber 52 and the ink supply flow channel 53);

Evaporation condition 8: shape and dimensions of the ejection flow channel 512 leading from the pressure chamber 52 to the nozzle 51;

Evaporation condition 9: efficiency of ink churning by the vibrating action (for example, the correspondence between the shape and the churned volume, or the correspondence between the vibrating action drive waveform and the churned volume);

Evaporation condition 10: amount of the vibrating action (for example, vibrating action duration, shape/amplitude/wavelength of the vibrating action drive waveform, and the like);

Evaporation condition 11: ink properties (for example, solvent volatility, solvent dispersibility, solvent latent heat, thermal conductivity, viscosity, temperature dependence of viscosity, and the like);

Evaporation condition 12: ink temperature (desirably, the ink temperature in the vicinity of each of the nozzles 51);

Evaporation condition 13: actuator characteristics (vibrating force: the drive force of the actuator during the vibrating action when the ink has increased in viscosity and resistance and has become more difficult to move); and Evaporation condition 14: relative speed of the liquid ejection head 50 and the recording medium (for example, the conveyance speed of the recording medium).

Taking these evaporation conditions as parameters, the solvent volume evaporating from the free surface of the ink in the nozzle 51 (or the solvent concentration or viscosity of the ink in the vicinity of the free surface in the nozzle 51) is determined, for each of the nozzles 51.

Of the evaporation conditions described above, the fixed parameters, such as the shape, ink properties, actuator characteristics, and the like, are previously stored in the memory 151 shown in FIG. 1, in the form of constants, formulae, or a table.

On the other hand, the parameters that may change (variable parameters), such as the ambient temperature, ambient humidity, solvent vapor pressure, ink temperature, ink churning history, ink ejection history, and the like, are acquired during the operation of the image forming apparatus 10.

The ambient temperature is measured by means of a temperature sensor provided in the liquid ejection head 50, for example. The ambient humidity is measured by means of a humidity sensor provided in the liquid ejection head 50, for example. The solvent vapor pressure is determined on the basis of the ambient temperature and the ambient humidity. The ink temperature is measured by means of a temperature sensor provided in the liquid ejection head 50, for example.

The solvent evaporation volume (or the solvent concentration or ink viscosity) in the vicinity of the free surface of the ink is identified on the basis of these fixed parameters and variable parameters, and the timing of the vibrating action is specified accordingly.

There are various specific modes of determining the evaporation volume (or the solvent concentration or ink viscosity) in the vicinity of the free surface of the ink.

Firstly, there is a mode which calculates the evaporation volume for each nozzle 51, on the basis of various evaporation conditions described above. For example, the evaporation volume is calculated for each nozzle 51 on the basis of the ambient temperature, the ambient humidity, the solvent vapor pressure, the ink churning history, and the ink ejection history. Here, the ink churning history and the ink ejection history are created for each nozzle 51 by means of the head controller 150 or the system controller 113, and are stored in the memory 151 or 112 for use. Furthermore, the elapsed time after the ejection and the ejection intervals, the elapsed time after the vibrating action and the vibrating action intervals, the elapsed time after the purging and the purging interval, and the elapsed time after the suctioning and the suctioning interval are measured by the timer 16 and are included in the ejection history or the churning history. There are a variety of modes for calculating the evaporation volume, by taking as one or more parameters, one of the above-described evaporation conditions, or various combinations of the above-described evaporation conditions.

Secondly, there is a mode which calculates the evaporation volume for each nozzle 51, on the basis of the above-described evaporation conditions recorded in the information table.

Thirdly, there is a mode which makes combined use of the pressure sensors 70 for detecting ejection abnormalities. In the present embodiment, the solvent evaporation volume (or the solvent concentration or ink viscosity) at the free surface of the ink is determined for each nozzle 51 on the basis of the pressure inside the pressure chamber 52 measured by the pressure sensor 70 provided on the wall of the pressure chamber 52 as shown in FIG. 3. In other words, while the ink in the vicinity of the free surface is in a state of increased viscosity, the ink inside the pressure chamber 52 is vibrated by using the actuator 58 to a level whereby the solvent concentration of the ink is hardly restored at all, and the solvent evaporation volume is determined on the basis of the output signal (pressure measurement signal) of the pressure sensor 70 obtained for each nozzle 15. More specifically, the resonance waveform showing the temporal change of the pressure measured by the pressure sensor 70 is compared with the normal resonance waveform where there has been no increase in the viscosity of the ink, and the solvent evaporation volume is determined on the basis of the difference in the wavelengths (or the divergence between the resonance points) of the resonance waveforms and/or the difference in the amplitude between the resonance waveforms. By acquiring the solvent evaporation volume for each nozzle 51 in this way, it is possible to judge whether or not the nozzle 51 needs the vibrating action.

Figures 11A, 11B:
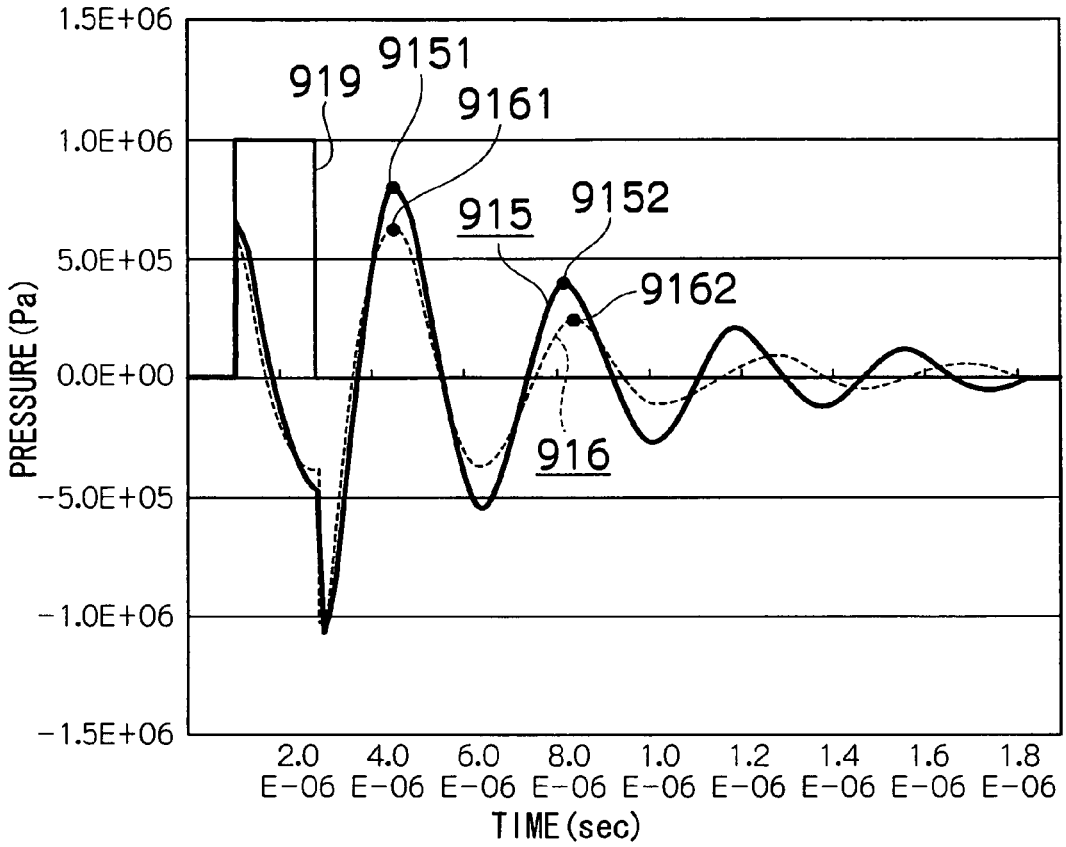
FIGS. 11A and 11B are diagrams showing the temporal change in the pressure and information table.

FIG. 11A shows a resonance waveform 915 in a normal state (in this case, where the overall viscosity of the ink is 10 cP), when the ink inside the pressure chamber 52 is pressurized by the actuator 58, and a resonance waveform 916 shows a case of increased viscosity (in this case, where the viscosity of the ink in the nozzle 51 is 20 cP, which is twice the normal value). A drive waveform 919 input to the actuator 58 is also depicted in FIG. 11A.

The resonance waveforms 915 and 916 in FIG. 11A are calculated to indicate the pressure change in the nozzle section (the portion corresponding to the nozzle length mentioned below), under the following calculation conditions:

Nozzle diameter: 30 μm;

Nozzle length: 30 μm (where a supply restrictor has the same shape as the nozzle);

Pressure chamber size: 0.3 mm×0.3 mm×0.15 mm;

Compliance of actuator: $1\times10^{-20}$ $m^3$/Pa;

Input pressure: 1 MPa (amplitude in one direction); and

Pulse width: 1.87 μsec.

The cycles and logarithmic decrements determined on the basis of the first peaks 9151 and 9161 and the second peaks 9152 and 9262, which are the resonance points of the resonance waveforms 915 and 916 shown in FIG. 11A, are indicated in the information table in FIG. 11B. The information table determined by these calculations, and/or information table determined by measurement is previously stored in the second memory 151 in FIG. 1.

The viscosity of the ink in the vicinity of the free surface in the nozzle 51 is obtained by firstly determining the cycle and/or logarithmic decrement through analyzing the output signal of the pressure sensor 70 (the pressure measurement signal), and then comparing the cycle and/or logarithmic decrement resulting from this analysis with the figure in the information table shown in FIG. 11B. In other words, the increased viscosity state judgment unit 162 shown in FIG. 1 determines at least one of the solvent evaporation volume, the solvent concentration and the viscosity of the ink in the vicinity of the free surface on the basis of the resonance waveform output from the sensor signal processing unit 156 and the information table previously stored in the second memory 151.

Fourthly, there is a mode in which a concentration measurement sensor is provided in the vicinity of the nozzle 51 (and most desirably, in the vicinity of the free surface of the ink), and the solvent concentration of the ink is measured directly by the concentration measurement sensor. For example, a sensor which measures the solvent concentration of the ink on the basis of the electrical conductivity of the ink is used.

The foregoing description related principally to cases where the solvent concentration of the ink is maintained (or the ink viscosity is maintained) by the vibrating action to the free surface of the ink, but in addition to the vibrating action, it is also possible to make combined use of a device which circulates the ink, and/or a device which injects additional ink.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

a nozzle which ejects liquid;

a pressure chamber which is connected to the nozzle;

an actuator which generates pressure applied to the liquid inside the pressure chamber, the actuator driving liquid ejection for ejecting the liquid from the nozzle, the actuator driving vibrating action to the liquid for causing a free surface of the liquid in the nozzle to vibrate to an extent that does not eject the liquid from the nozzle;

a viscosity state judgment device which judges viscosity states of the liquid in a vicinity of the free surface of the liquid in the nozzle, the viscosity states including a first state in which the liquid ejection from the nozzle is possible and the vibrating action is not required for the nozzle, a second state in which the liquid ejection from the nozzle is possible and the vibrating action is required for the nozzle, and a third state in which the liquid ejection from the nozzle is not possible and restoration to the first state is possible if the vibrating action is performed for the nozzle; and a control device which, in a case where the liquid ejection from the nozzle is to be performed, controls in the first state so as to perform the liquid ejection from the nozzle without performing the vibrating action for the nozzle, and controls in either one of the second state and the third state so as to perform the liquid ejection from the nozzle after performing the vibrating action for the nozzle, and which, in a case where the liquid ejection from the nozzle is not to be performed, controls in either one of the first state and the second state so as not to perform the vibrating action for the nozzle, and controls in the third state so as to perform the vibrating action for the nozzle, wherein the viscosity state judgment device judges at least one of an evaporation volume and a solvent concentration of the liquid at the free surface in the nozzle in order to judge the viscosity states of the liquid in a vicinity of the free surface of the liquid in the nozzle.

2. The liquid ejection apparatus as defined in claim 1, wherein the viscosity state judgment device judges the viscosity states according to an evaporation condition indicating the at least one of the evaporation volume and the solvent concentration of the liquid at the free surface of the nozzle, the evaporation condition including at least one of temperature in a vicinity of the nozzle, humidity in the vicinity of the nozzle, a vapor pressure of solvent of the liquid, a history of the vibrating action for the nozzle, and a history of the liquid ejection from the nozzle.

3. The liquid ejection apparatus as defined in claim 2, further comprising:

a storage device which stores information indicating a relationship between the evaporation condition and the viscosity state in a form of one of a formula and a table, wherein the viscosity state judgment device judges the viscosity state according to the information stored in the storage device.

4. A liquid ejection apparatus, comprising:

a nozzle which ejects liquid;

a pressure chamber which is connected to the nozzle;

an actuator which generates pressure applied to the liquid inside the pressure chamber, the actuator driving liquid ejection for ejecting the liquid from the nozzle, the actuator driving vibrating action to the liquid for causing a free surface of the liquid in the nozzle to vibrate to an extent that does not eject the liquid from the nozzle;

a viscosity state judgment device which judges a viscosity state of the liquid in a vicinity of the free surface of the liquid in the nozzle; and a control unit which, in a case where the liquid ejection from the nozzle is to be performed, controls so as to perform the vibrating action using the actuator before the viscosity state of the liquid in the vicinity of the free surface has reached a state where the liquid ejection from the nozzle is impossible and then controls so as to perform the liquid ejection using the actuator, and which, in a case where the liquid ejection from the nozzle is not to be performed, controls so as to restrict a frequency of the vibrating action even if the viscosity state of the liquid in the vicinity of the free surface has reached the state where the liquid ejection from the nozzle is impossible while the viscosity state of the liquid in the vicinity of the free surface is able to be restored by the vibrating action, wherein the viscosity state judgment device judges at least one of an evaporation volume and a solvent concentration of the liquid at the free surface in the nozzle in order to judge the viscosity states of the liquid in a vicinity of the free surface of the liquid in the nozzle.

5. The liquid ejection apparatus as defined in claim 4, wherein the viscosity state judgment device judges the viscosity state according to an evaporation condition indicating the at least one of the evaporation volume and the solvent concentration of the liquid at the free surface of the nozzle, the evaporation condition including at least one of temperature in a vicinity of the nozzle, humidity in the vicinity of the nozzle, a vapor pressure of solvent of the liquid, a history of the vibrating action for the nozzle, and a history of the liquid ejection from the nozzle.

6. The liquid ejection apparatus as defined in claim 5, further comprising:

a storage device which stores information indicating a relationship between the evaporation condition and the viscosity state in a form of one of a formula and a table, wherein the viscosity state judgment device judges the viscosity state according to the information stored in the storage device.

7. A control method for a liquid ejection apparatus, comprising the steps of:

judging viscosity stares of liquid in a vicinity of a free surface of the liquid in a nozzle which ejects the liquid, the viscosity states including a first state in which liquid ejection from the nozzle is possible and vibrating action is not required for the nozzle, a second state in which the liquid ejection from the nozzle is possible and the vibrating action is required for the nozzle, and a third state in which the liquid ejection from the nozzle is not possible and restoration to the first state is possible if the vibrating action is performed for the nozzle;

in a case where the liquid ejection from the nozzle is to be performed, performing the liquid ejection from the nozzle without performing the vibrating action for the nozzle in the first state, and performing the liquid ejection from the nozzle after performing the vibrating action for the nozzle in either one of the second state and the third state; and in a case where the liquid ejection from the nozzle is not to be performed, not performing the vibrating action for the nozzle in either one of the first state and the second state, and performing the vibrating action for the nozzle in the third state, wherein the viscosity state judging step is performed by determining at least one of an evaporation volume and a solvent concentration of the liquid at the free surface in the nozzle, and judging the viscosity state according to the determination.

* * * * *